US012259153B2

(12) United States Patent
Cho et al.

(10) Patent No.: US 12,259,153 B2
(45) **Date of Patent: *Mar. 25, 2025**

(54) AIR CONDITIONER

(71) Applicant: Samsung Electronics Co., Ltd., Suwon-si (KR)

(72) Inventors: Sang Ki Cho, Seoul (KR); Ki Jun Kim, Suwon-si (KR); Dae Dong Kim, Yongin-si (KR); Chang Heon Lee, Yongin-si (KR); Moon Sun Shin, Suwon-si (KR); Young Lae Jo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 18/221,481

(22) Filed: Jul. 13, 2023

(65) Prior Publication Data

US 2023/0358434 A1 Nov. 9, 2023

Related U.S. Application Data

(63) Continuation of application No. 17/032,677, filed on Sep. 25, 2020, now Pat. No. 11,739,976, which is a (Continued)

(30) Foreign Application Priority Data

Oct. 27, 2016 (KR) ..... 10-2016-0141090

(51) Int. Cl.
*F24F 13/14* (2006.01)
*F24F 1/0003* (2019.01)

(Continued)

(52) U.S. Cl.
CPC ..... *F24F 13/14* (2013.01); *F24F 1/0011* (2013.01); *F24F 1/0057* (2019.02); *F24F 1/0003* (2013.01);

(Continued)

(58) Field of Classification Search
CPC ..... F24F 13/14; F24F 1/0011; F24F 1/0057; F24F 1/0003; F24F 11/74; F24F 2013/205

(Continued)

(56) References Cited

U.S. PATENT DOCUMENTS 10,458,673 B2 * 10/2019 Cho ..... F24F 1/0057
2014/0097730 A1 4/2014 Kim (Continued)

FOREIGN PATENT DOCUMENTS

CN 100572939 12/2009
CN 203605328 U 5/2014

(Continued)

OTHER PUBLICATIONS

Korean Office Action dated Sep. 4, 2017 in Korean Patent Application No. 10- 2016-0141090.

(Continued)

*Primary Examiner* — Steven B McAllister
*Assistant Examiner* — Charles R Brawner
(74) *Attorney, Agent, or Firm* — STAAS & HALSEY LLP

(57) ABSTRACT

An air conditioner includes a discharge blade configured to move between a guide position at which a direction of air blown from a blower fan and discharged to an outlet is controlled, and a closing position at which the outlet is closed, wherein the discharge blade includes a plurality of blade holes through which the air is discharged through the discharge blade at the closing position, wherein the dis- (Continued)

charge blade moves between the guide position and the closing position and controls an air flow from the blower fan to a discharge plate or the outlet. Through this configuration, an air flow discharged to the outside of the housing can be controlled by operation of the discharge blade.

10 Claims, 24 Drawing Sheets

Related U.S. Application Data continuation of application No. 15/992,409, filed on May 30, 2018, now Pat. No. 10,788,238, which is a continuation of application No. 15/720,052, filed on Sep. 29, 2017, now Pat. No. 10,458,673.

(51) Int. Cl.
*F24F 1/0011* (2019.01)
*F24F 1/0057* (2019.01)
*F24F 11/74* (2018.01)
*F24F 13/20* (2006.01)

(52) U.S. Cl.
CPC ..... *F24F 11/74* (2018.01); *F24F 2013/205* (2013.01)

(58) Field of Classification Search
USPC ..... 454/333
See application file for complete search history.

(56) References Cited

U.S. PATENT DOCUMENTS

| | | | |
|---|---|---|---|
| 2016/0281998 | A1 | 9/2016 | Fujita |
| 2018/0274814 | A1 | 9/2018 | Cho |

FOREIGN PATENT DOCUMENTS

| | | | |
|---|---|---|---|
| CN | 204084595 | | 1/2015 |
| CN | 204739747 | | 11/2015 |
| CN | 105180267 | | 12/2015 |
| CN | 105546784 | | 5/2016 |
| EP | 0645587 | | 3/1995 |
| EP | 1780474 | A2 | 5/2007 |
| EP | 2762795 | | 8/2014 |
| GB | 2415247 | | 12/2005 |
| JP | 2001-304674 | | 10/2001 |
| JP | 2002-98397 | | 4/2002 |
| JP | 2012-93043 | | 5/2012 |
| JP | 2013-96638 | | 5/2013 |
| JP | 2016-99030 | | 5/2016 |
| JP | 2016-99032 | | 5/2016 |
| KR | 10-2015-0011556 | | 2/2015 |
| KR | 10-2015-0018201 | | 2/2015 |
| KR | 10-2015-0031832 | | 3/2015 |
| KR | 10-1890869 | | 8/2018 |
| RU | 2327932 | | 6/2008 |
| RU | 2351851 | | 4/2009 |
| RU | 88107 | | 10/2009 |
| RU | 2382284 | | 2/2010 |
| WO | 2013065437 | A1 | 5/2013 |

OTHER PUBLICATIONS

International Search Report dated Jan. 30, 2018 in International Patent Application No. PCT/KR2017/011459.
Korean Office Action dated Jan. 19, 2018 in Korean Patent Application No. 10-2016-0141090.
JP2001304674MT; machine translation of JP 2001130467 (Cited in the Office Action dated Nov. 17, 2017 in U.S. Appl. No. 15/720,052).
JP2016099030MT; machine translation of JP 2016099030 (Cited in the Office Action dated Nov. 17, 2017 in U.S. Appl. No. 15/720,052).
US Office Action dated Nov. 17, 2017 in U.S. Appl. No. 15/720,052.
US Office Action dated Jun. 13, 2018 in U.S. Appl. No. 15/720,052.
Extended European Search Report dated Apr. 24, 2018 in European Patent Application No. 17196205.3.
Korean Notice of Allowance dated May 18, 2018 in Korean Patent Application No. 10-2016-0141090.
US Office Action dated Nov. 16, 2018 in U.S. Appl. No. 15/720,052.
Russian Search Report dated Dec. 13, 2018 in Russian Patent Application No. 2018122081.
Extended European Search Report dated Oct. 15, 2018 in European Patent Application No. 18173358.5.
Russian Notice of Allowance dated Feb. 12, 2019 in Russian Patent Application No. 2018122081.
Australian Office Action dated Jan. 31, 2019 in Australian Patent Application No. 2017332968.
US Notice of Allowance dated Jun. 26, 2019 in U.S. Appl. No. 15/720,052.
Chinese Office Action dated Aug. 1, 2019 in Chinese Patent Application No. 201711006890.7.
Indonesian Office Action dated Oct. 3, 2019 in Indonesian Patent Application No. P00201807871.
Chinese Office Action dated Apr. 16, 2020 in Chinese Patent Application No. 201711006890.7.
Chinese Office Action dated Jul. 1, 2020 in Chinese Patent Application No. 201810471056.3.
US Office Action dated Nov. 16, 2018 in U.S. Appl. No. 15/992,409.
US Office Action dated May 31, 2019 in U.S. Appl. No. 15/992,409.
US Office Action dated Dec. 12, 2019 in U.S. Appl. No. 15/992,409.
US Notice of Allowance dated Jun. 17, 2020 in U.S. Appl. No. 15/992,409.
US Notice of Allowance dated Apr. 14, 2023 in U.S. Appl. No. 17/032,677.
Indian Office Action dated Oct. 21, 2020 in Indian Patent Application No. 201917020647.
Chinese Office Action dated Jan. 8, 2021 from Chinese Application No. 201711006890.7, 12 pages total.
Chinese Office Action dated Mar. 22, 2021 from Chinese Application No. 201810471056.3, 15 pages total.
Vietnamese Office Action dated Mar. 31, 2021 from Vietnamese Application No. 1-2018-02392, 4 pages.
Chinese Office Action dated Sep. 22, 2021 from Chinese Application No. 201810471056.3.
Chinese Office Action dated Aug. 2, 2021 from Chinese Application No. 201711006890.7.
Brazilian Office Action dated Nov. 3, 2021 from Brazilian Application No. BR112018008535-9.
Iranian Office Action dated Dec. 11, 2021 from Iranian Application No. 139750140003001372.
Korean Office Action dated Dec. 1, 2021 from Korean Application No. 10-2018-0095397.
U.S. Appl. No. 17/032,677, filed Sep. 25, 2020, Sang Ki Cho, et al., Samsung Electronics Co., Ltd.
U.S. Appl. No. 15/992,409, filed May 30, 2018, Sang Ki Cho, et al., Samsung Electronics Co., Ltd.
U.S. Appl. No. 15/720,052, filed Sep. 29, 2017, Sang Ki Cho, et al., Samsung Electronics Co., Ltd.
Office Action dated Oct. 14, 2023, in Chinese Application No. 202210291081.X.
Office Action dated Aug. 1, 2024 issued in Chinese Application No. 202210291081.X.

* cited by examiner

AIR CONDITIONER

CROSS-REFERENCE TO RELATED APPLICATION

This application is a continuation of U.S. patent application Ser. No. 17/032,677, filed on Sep. 25, 2020, which is a continuation of U.S. patent application Ser. No. 15/992,409, filed on May 30, 2018, which is a continuation of U.S. patent application Ser. No. 15/720,052, filed on Sep. 29, 2017, which claims the benefit of Korean Patent Application No. 10-2016-0141090, filed on Oct. 27, 2016 in the Korean Intellectual Property Office, the disclosures of which are incorporated herein by reference.

BACKGROUND

1. Field

The following description relates to an air conditioner, and more particularly, to an air conditioner that varies an air discharge method.

2. Description of the Related Art

Generally, an air conditioner is an apparatus that controls a temperature, humidity, an air current, a distribution, and the like which are suitable for human activities using a refrigerating cycle. Main components for forming the refrigerating cycle include a compressor, a condenser, an evaporator, a blower fan, etc.

The air conditioner can be classified into a separated split type air conditioner in which an indoor unit and an outdoor unit are installed and separated from each other, and an integrated air conditioner in which the indoor unit and the outdoor unit are installed together in one cabinet. The indoor unit of the separated split type air conditioner includes a heat exchanger that performs heat-exchanging on air suctioned into a panel, and a blower fan that suctions interior air into the panel and blows the suctioned air indoors. An indoor unit of a conventional air conditioner is manufactured to minimize a heat exchanger thereof, to increase a revolutions per minute (RPM) of a blower fan, and to maximize a wind speed and a wind volume. Thus, a discharge temperature is decreased, and discharged air forms a narrow and long flow path and is discharged into an interior space.

A user can feel cold and uncomfortable when the user is in direct contact with the discharged air, whereas, the user can feel hot and uncomfortable when the user is not in contact with the discharged air.

In addition, when the RPM of the blower fan is increased to realize a fast wind speed, noise thereof is increased. A radiant air conditioner that conditions air without using a blower fan requires a large panel to produce the same capability as a capability of an air conditioner that uses a blower fan. Also, an air-conditioning speed is very slow, and high construction costs are generated.

SUMMARY

Therefore, it is an aspect of the present disclosure to provide an air conditioner having various air discharge methods.

It is another aspect of the present disclosure to provide an air conditioner that air conditions and heats an interior space with a minimum wind speed at which a user feels comfortable.

It is another aspect of the present disclosure to provide an air conditioner that performs air conditioning through convection by minimizing a wind speed and realizes radiant air conditioning near the air conditioner.

Additional aspects of the disclosure will be set forth in part in the description which follows and, in part, will become obvious from the description, or may be learned by practice of the disclosure.

In accordance with one aspect of the present disclosure, an air conditioner includes: a housing including a discharge plate having a plurality of holes formed therein, and an outlet; a heat exchanger disposed inside the housing; a blower fan configured to blow air heat-exchanged by the heat exchanger toward the discharge plate or the outlet; and a discharge blade configured to move between a guide position at which a direction of the air blown from the blower fan and discharged to the outlet is controlled, and a closing position at which the outlet is closed, wherein the discharge blade includes a plurality of blade holes through which the air is discharged through the discharge blade at the closing position, wherein the discharge blade may move between the guide position and the closing position and control an air flow from the blower fan to the discharge plate or the outlet.

An operation of opening the outlet and an operation of blocking the air flow to the discharge plate may be performed together at the guide position.

The discharge blade may include a blade body corresponding to the outlet and having the plurality of blade holes formed therein, wherein the blade body is configured to block an air flow moving toward the discharge plate when the discharge blade is at the guide position.

The air conditioner may further include a flow path guide including a first flow path guide configured to form a first flow path through which the air flows from the blower fan to the outlet, and a second flow path configured to form a second flow path which diverges from the first flow path and through which the air flows through the plurality of holes, wherein the discharge blade may be configured to selectively block the first and second flow paths.

The blade body may include: a guide part configured to control the direction of the air blown from the blower fan at the guide position; and a flow path door part extending from the guide part and configured to block the second flow path at the guide position.

The second flow path guide may include a curved surface guide configured to form a rotation space of the flow path door part at the guide position, and an end of the flow path door part may move along an inner surface of the curved surface guide.

The discharge plate may be disposed at sides of the housing and a front side of the housing at which the outlet is disposed.

The discharge plate may include a first section and a pair of second sections disposed at both sides of the first section, and a plurality of holes in the first section may have a larger size than that of a plurality of holes in the second section.

The housing may include an outlet forming part configured to form the outlet, and the discharge blade may include at least one separation protrusion formed at one end of the discharge blade so as to form a predetermined gap with the outlet forming part.

The at least one separation protrusion may include a plurality of separation protrusions spaced a predetermined distance apart from each other in a longitudinal direction of the discharge blade.

The plurality of holes may have at least one of a circular shape and a polygonal shape.

The air conditioner may further include a housing door provided in the housing to be slidable so that the discharge plate and the discharge blade are not exposed to the outside.

The discharge blade may rotate and move between the guide position and the closing position.

In accordance with an aspect of the present disclosure, an air conditioner includes: a housing including an outlet and a discharge plate having a plurality of holes formed adjacent to the outlet; a heat exchanger disposed inside the housing; a blower fan configured to blow air heat-exchanged by the heat exchanger; a discharge blade configured to be movable between a guide position at which the outlet is open and air blown from the blower fan is guided, and a closing position at which the outlet is closed, wherein the discharge blade includes a plurality of blade holes through which the air is discharged through the discharge blade at the closing position; and a flow path blade configured to block an air flow from the blower fan to the discharge plate.

The flow path blade and the discharge blade may operate independently.

The housing may include an outlet forming part configured to form the outlet, and the air conditioner may further include a moving blade configured to fill a gap formed between the discharge blade and the outlet forming part due to an operation of the discharge blade.

The discharge plate may include an insertion space into which at least a part of the moving blade is inserted so that the moving blade advances and retreats with respect to the discharge plate, and the moving blade may have one side disposed in the insertion space and the other side in contact with the discharge blade.

The moving blade may operate in conjunction with an operation of the discharge blade.

In accordance with an aspect of the present disclosure, an air conditioner includes: a housing including a discharge plate having a plurality of holes formed therein, and an outlet; a heat exchanger disposed inside the housing and performing heat exchanging with air introduced into the housing; a blower fan configured to blow air heat-exchanged by the heat exchanger; and a discharge blade configured to control a direction of air discharged to the outlet and to open/close the outlet, wherein the discharge blade has a plurality of blade holes through which the air is discharged through the discharge blade when the outlet is closed by the discharge blade, wherein the discharge blade may close one of the outlet and the discharge plate so that the air blown from the blower fan flows toward the other one of the outlet and the discharge plate.

The air conditioner may further include a flow path guide including a first flow path guide configured to form a first flow path through which the air blown from the blower fan flows, and a second flow path guide configured to form a second flow path which diverges from the first flow path and through which the air flows toward the discharge plate, wherein the discharge blade may be configured to open any one of the first and second flow path guides by a rotation operation.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
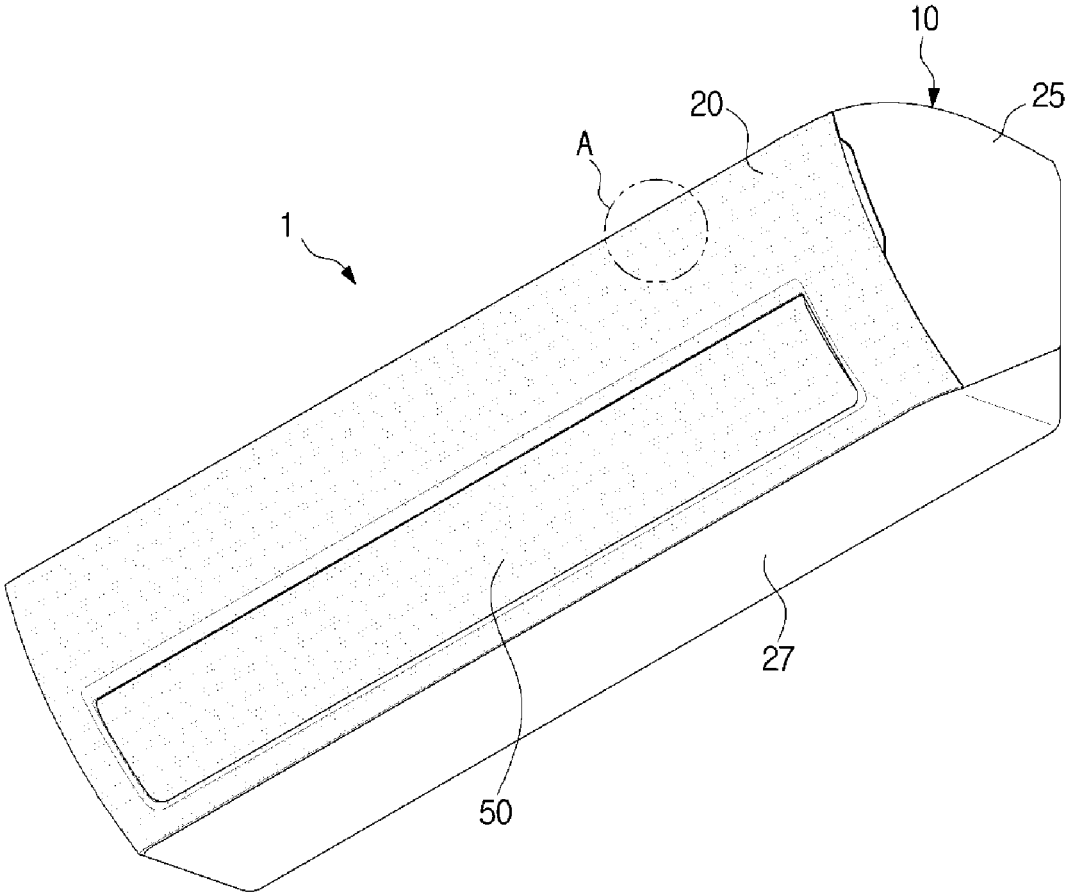
FIG. 1 is a perspective view of an air conditioner according to an embodiment of the present disclosure.

Embodiments described in the present specification and configurations shown in the drawings are just exemplary embodiments of the disclosure, and there may be various modifications that may replace the embodiments of the present specification and the drawings at the time of filing the present application.

Like reference numerals or symbols in each of the drawings of the present specification represent components or elements that perform substantially the same functions.

The terms used in the present specification are merely used to describe particular embodiments and are not intended to limit and/or restrict the present disclosure. An expression used in the singular encompasses the expression of the plural unless it has a clearly different meaning in context. In the present specification, it should be understood that the terms such as "including," "having," or the like are intended to indicate the existence of features, numbers, steps, actions, components, parts, or combinations thereof disclosed in the specification, and are not intended to preclude the possibility that one or more other features, numbers, steps, actions, components, parts, or combinations thereof may exist or may be added.

It should be understood that although the terms "first," "second," and the like are used herein to describe various elements, these elements are not limited by these terms. These terms are only used to distinguish one element from another element. For example, a first element discussed below could be termed a second element, and similarly, a second element may be termed a first element without departing from the teachings of this disclosure. As used herein, the term "and/or" includes any and all combinations of one or more of the associated listed items.

Hereinafter, embodiments according to the present disclosure will be described in detail with reference to the attached drawings.

A refrigerating cycle that is constituted by an air conditioner includes a compressor, a condenser, an expansion valve, and an evaporator. The refrigerating cycle includes a series of procedures including compression-condensation-expansion-evaporation, performs heat-exchanging between high-temperature air and a low-temperature refrigerant, and then supplies the low-temperature air into an internal space.

The compressor compresses a refrigerant gas in a high-temperature and high-pressure state and discharges the compressed refrigerant gas to introduce the discharged refrigerant gas into the condenser. The condenser condenses the compressed refrigerant in a liquid state and dissipates heat around the condenser through a condensation procedure. The expansion valve expands a liquid refrigerant in the high-temperature and high-pressure state condensed by the condenser into a liquid refrigerant having a low-pressure state. The evaporator evaporates the refrigerant expanded by the expansion valve. The evaporator achieves a cooling effect by heat-exchanging with an object to be cooled by using latent heat of evaporation of the refrigerant and returns the refrigerant gas having a low-temperature and low-pressure state to the compressor. Through this cycle, an air temperature of an interior space can be controlled.

An outdoor unit of the air conditioner includes the compressor of the refrigerating cycle and an outdoor heat exchanger. The expansion valve may be disposed in any one of an indoor unit and the outdoor unit, and an indoor heat exchanger is in the indoor unit of the air conditioner.

The present disclosure relates to an air conditioner that air conditions an interior space, and the outdoor heat exchanger serves as a condenser while the indoor heat exchanger serves as an evaporator. Hereinafter, for convenience, the indoor unit including the indoor heat exchanger is referred to as an air conditioner, and the indoor heat exchanger is referred to as a heat exchanger.

Figure 2:
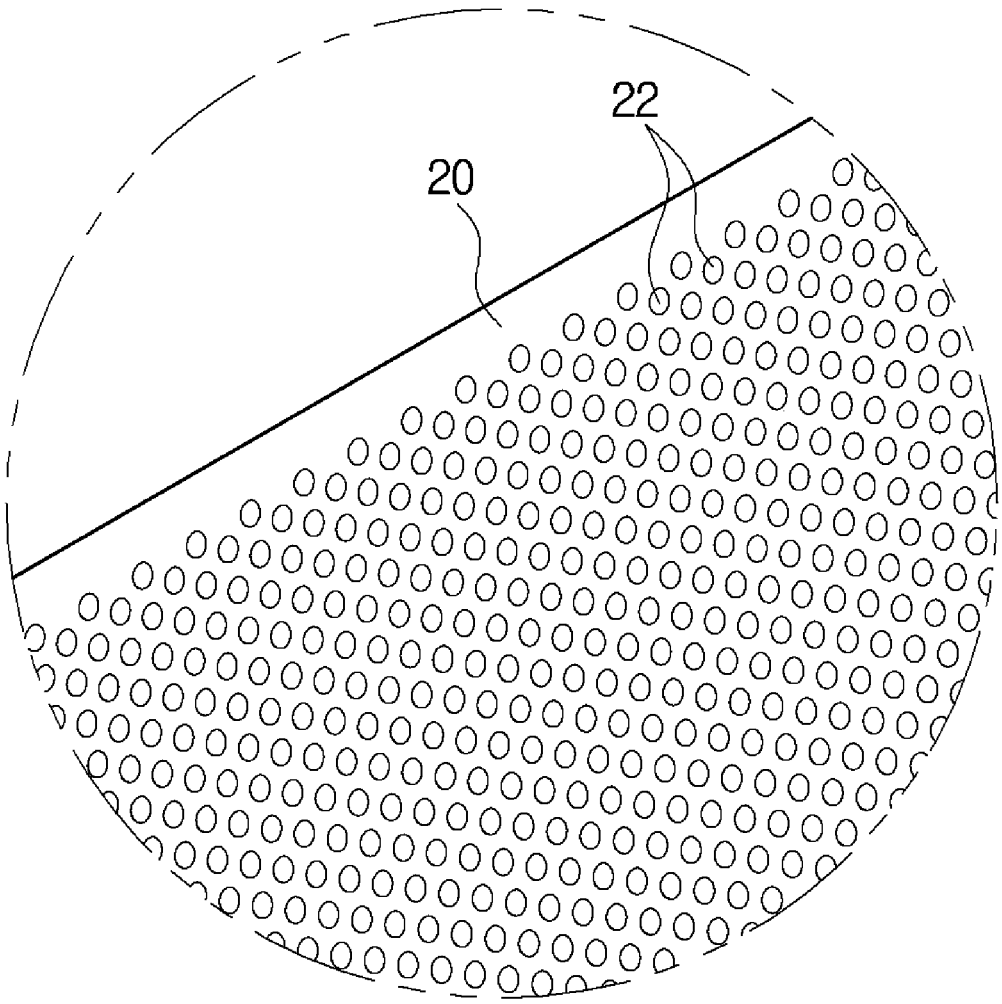
FIG. 2 is an enlarged view of portion A of FIG. 1.
Figure 3:
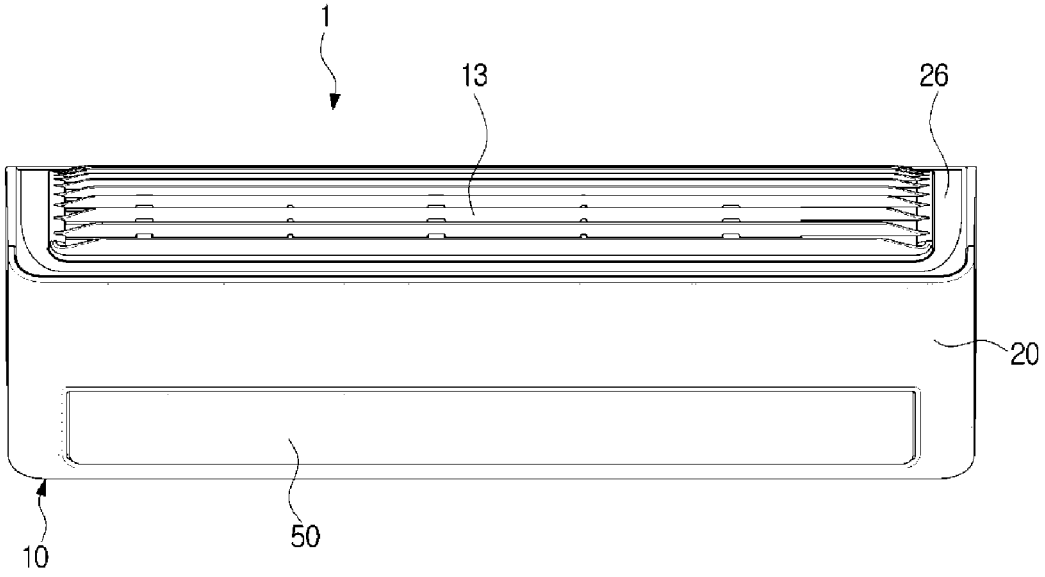
FIG. 3 is a front view of an air conditioner according to an embodiment of the present disclosure.
Figure 4:
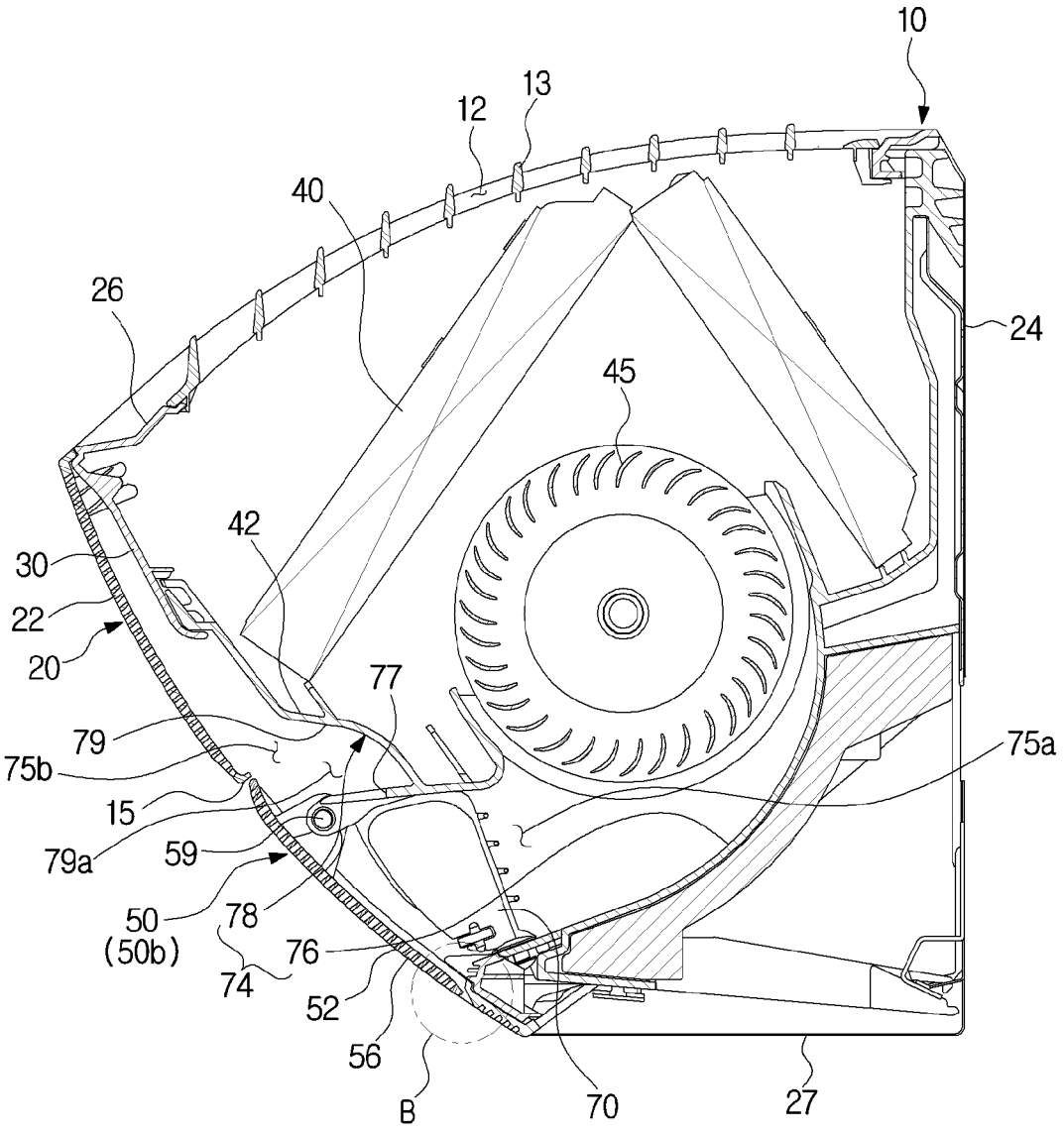
FIG. 4 is a cross-sectional view of an air conditioner according to an embodiment of the present disclosure.

FIG. 1 is a perspective view of an air conditioner according to an embodiment of the present disclosure, FIG. 2 is an enlarged view of portion A of FIG. 1, FIG. 3 is a front view of an air conditioner according to an embodiment of the present disclosure, and FIG. 4 is a cross-sectional view of an air conditioner according to an embodiment of the present disclosure.

An air conditioner 1 includes a housing 10 having an inlet 12 and an outlet 14, a heat exchanger 40 that performs heat exchanging with air introduced into the housing 10, and a blower fan 45 that circulates the air to an inside or outside of the housing 10.

The air conditioner 1 may be a wall-hanging type air conditioner 1 installed on a wall surface, but embodiments of the present disclosure are not limited thereto.

The housing 10 may form an entire exterior of the air conditioner 1. The housing 10 may include a discharge plate 20 having a plurality of holes 22 formed therein. The plurality of holes 22 may be distinguished from the outlet 14. The plurality of holes 22 may be distributed in the discharge plate 20, as shown in FIG. 2, and a width of each of the holes 22 may be smaller than that of the outlet 14. Also, air that flows in a second flow path 75*b*, which will be described later, may be discharged to the outside of the housing 10 through the plurality of holes 22. The plurality of holes 22 may be distributed in the discharge plate 20 to be spaced a predetermined distance apart from each other, as illustrated in FIG. 2. However, embodiments of the present disclosure are not limited thereto, and the holes 22 may also be distributed to be concentrated in a particular region of the discharge plate 20. The air is discharged through the plurality of holes 22, a plurality of blade holes 56, which will be described later, and a plurality of holes 385 of a moving blade 384 so that the air can be discharged to the outside of the housing 10 at a low speed. Thus, a user is not directly contacted by wind, and a purpose of air conditioning can be achieved so that the user's satisfaction can be improved.

The housing 10 may include a front panel having the outlet 14 formed by an outlet forming part 15, a rear panel 24 disposed behind the front panel, a pair of side panels 25 disposed between the front panel and the rear panel 24, an upper panel 26 having the inlet 12 formed therein and disposed above the pair of side panels 25, and a lower panel 27 disposed below the pair of side panels 25. The outlet 14 and the inlet 12 are disposed in the front panel and the upper panel 26, respectively. However, embodiments of the present disclosure are not limited thereto. The front panel may have the same configuration as that of the above-described discharge plate 20. An inlet guide 13 that guides the air to the inlet 12 may be disposed in the upper panel 26. A plurality of inlet guides 13 may be formed in parallel in a longitudinal direction of the housing 10.

The air conditioner 1 may include a discharge blade 50 that opens/closes the outlet 14. The discharge blade 50 is rotatably disposed in the housing 10. In detail, the discharge blade 50 may be rotatable around a blade shaft 59 with respect to the discharge plate 20. The blade shaft 59 may be disposed on an inner surface of the discharge plate 20.

The discharge blade 50 may move between a closing position 50*b* at which the outlet 14 is closed, and a guide position 50*a* at which the outlet 14 is open and a direction of air blown from the blower fan 45 to be discharged to the outlet 14 is controlled. The guide position 50*a* is a position at which the discharge blade 50 opens the outlet 14 and the air discharged through the outlet 14 is guided in a predetermined angle range in which the discharge blade 50 controls the direction of the discharged air. The air conditioner 1 may control an air flow from the blower fan 45 to the discharge plate 20 or the outlet 14 by the discharge blade 50 moving between the guide position 50*a* and the closing position 50*b*. When the discharge blade 50 is at the guide position 50*a*, an operation of opening the outlet 14 and an operation of blocking an air flow to the discharge plate 20 may be performed together. When the discharge blade 50 is at the closing position 50*b*, an operation of closing the outlet 14 and releasing of the operation of blocking the air flow to the discharge plate 20 may be performed together.

The air conditioner 1 may include an auxiliary blade 70 that controls the direction of the air blown from the blower fan 45 at an inside of the discharge blade 50. The discharge blade 50 may control the blown air in a vertical direction, and the auxiliary blade 70 may control the blown air in a horizontal direction. At least one auxiliary blade 70 may be provided. In the current embodiment, a plurality of auxiliary blades 70 are spaced a predetermined distance apart from each other in the horizontal direction. The plurality of auxiliary blades 70 may be arranged in a longitudinal direction of the outlet 14. The auxiliary blades 70 may be disposed inside the discharge blade 50 to be configured not to be exposed to the outside when the discharge blade 50 is at the closing position 50*b*.

A sensor receiver (refer to 72 of FIG. 7) may be disposed in a lateral portion of the auxiliary blade 70. The sensor receiver 72 may be covered by the discharge blade 50 when the discharge blade 50 is at the closing position 50*b*. Even when the sensor receiver 72 is covered by the discharge blade 50, the sensor receiver 72 senses a signal through the plurality of holes 22 formed in the discharge blade 50 and transmits the signal to a controller (not shown) so that the air conditioner 1 can operate.

Figure 5:
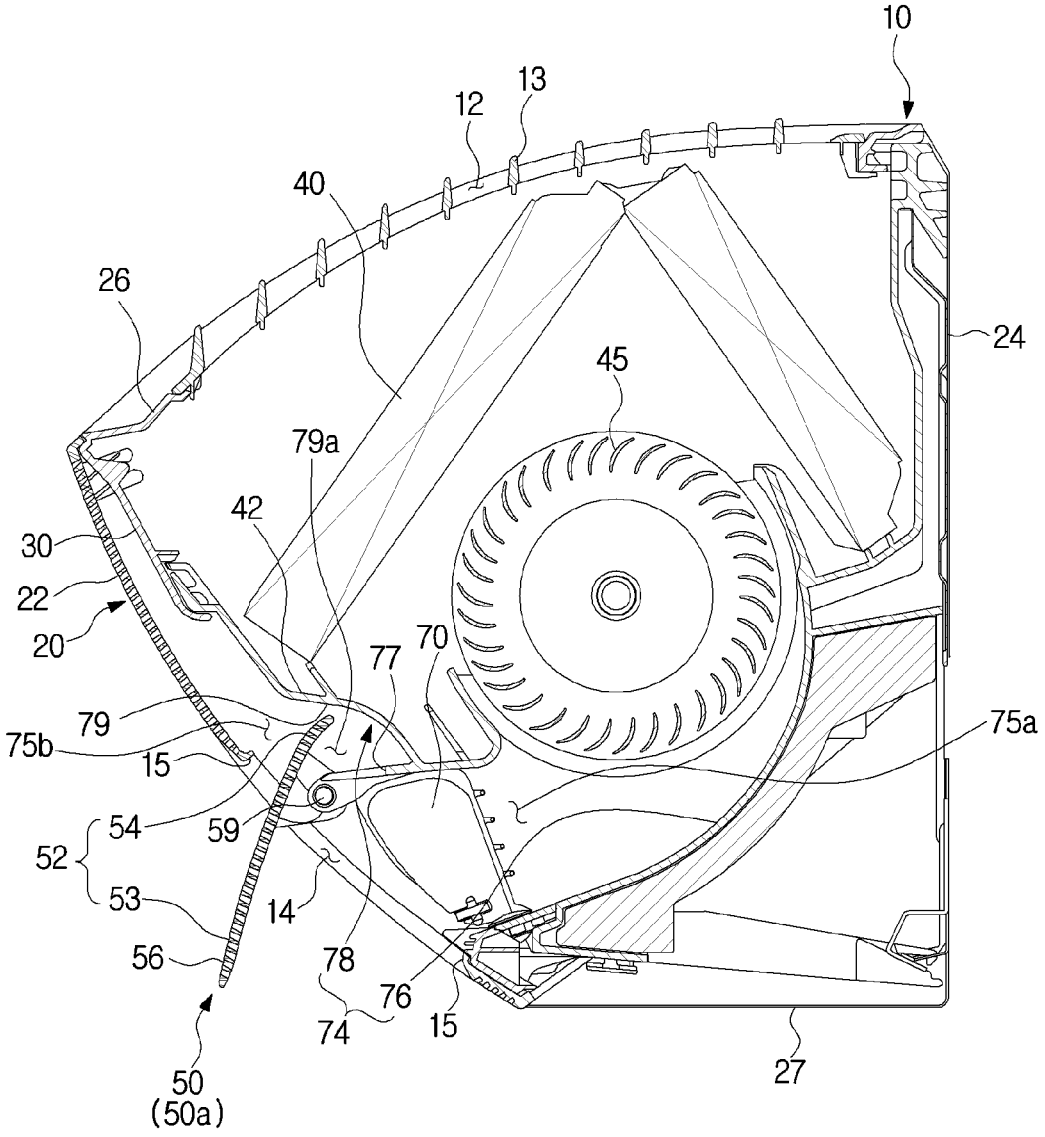
FIGS. 5 and 6 are views showing an operation of an air conditioner according to an embodiment of the present disclosure.
Figure 6:
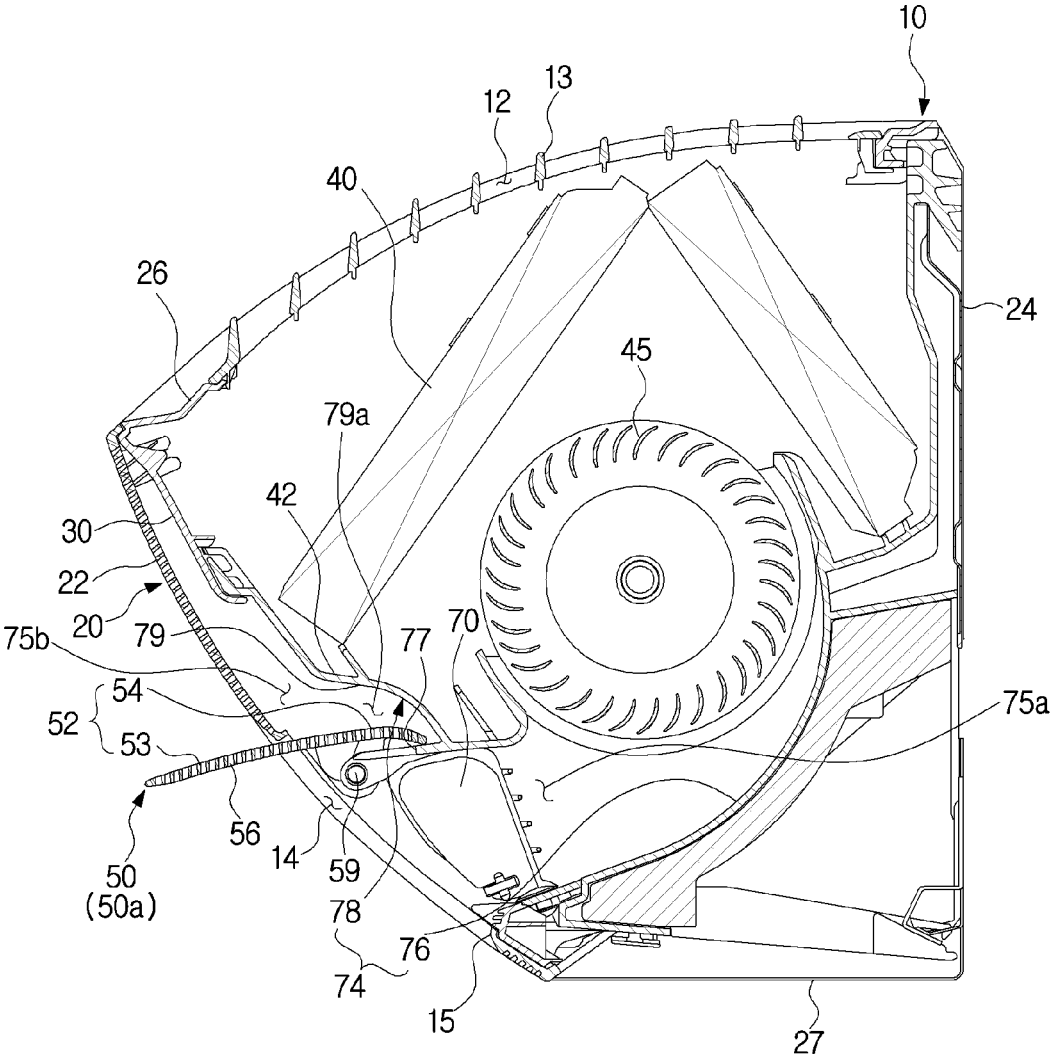

FIGS. 5 and 6 are views showing an operation of an air conditioner according to an embodiment of the present disclosure. The operation of the air conditioner according to the embodiment of the present disclosure will be described with reference to FIG. 4.

The heat exchanger 40 may be disposed inside the housing 10, and may be disposed on an air moving path from the inlet 12 to the outlet 14. The heat exchanger 40 is configured to absorb heat from air introduced into the inlet 12 or to transfer heat to the air. A drain panel 42 may be disposed below the heat exchanger 40 in order to collect moisture condensed in the heat exchanger 40. The drain panel 42 may be connected to a drain hose (not shown) connected to the outside of the housing 10 and may discharge the condensed moisture to the outside of the housing 10.

The blower fan 45 is disposed inside the housing 10. The blower fan 45 is configured to blow air so that the air can flow from the inlet 12 to the outlet 14 or the discharge plate 20. The blower fan 45 may be a cross flow fan having the same longitudinal direction as that of the housing 10.

The air conditioner 1 may include a flow path guide 74. The flow path guide 74 is configured to guide the air blown from the blower fan 45.

The flow path guide 74 may include a first flow path guide 76 and a second flow path guide 78.

The first flow path guide 76 is provided to form a first flow path 75*a* through which the air flows from the blower fan 45 to the outlet 14. The first flow path 75*a* may be connected to the outlet 14. The outlet 14 may be disposed at an end of the first flow path guide 76. The outlet 14 may be disposed on an extension line of the air moving path guided by the first flow path guide 76.

The second flow path guide 78 is provided to form a second flow path 75*b*. The second flow path 75*b* may be connected to the plurality of holes 22. In detail, the second flow path 75*b* is formed by the second flow path guide 78 and an inner surface of the discharge plate 20, and air that flows in the second flow path 75*b* may be discharged to the outside of the housing 10 through the plurality of holes 22 of the discharge plate 20. The second flow path 75*b* diverges from the first flow path 75*a*, and the air flows into the plurality of holes 22. A guide opening 77 is formed in the first flow path guide 76 so that air flowing in the first flow path 75*a* can flow in the second flow path 75*b*. The above-described drain panel 42 may be disposed on a rear surface of the second flow path guide 78.

The second flow path guide 78 may include a curved surface guide 79. The curved surface guide 79 may be formed as a curved surface in consideration of a rotation of the discharge blade 50. The curved surface guide 79 may form a rotation space 79*a* of a flow path door part 54 of the discharge blade 50, which will be described later. The rotation space 79*a* is a space in which a part of the second flow path 75*b* is formed and the flow path door part 54 is rotatable. Due to the rotation space 79*a* formed in an inside of the curved surface guide 79, the discharge blade 50 is not interfered with by the curved surface guide 79 and is rotatable.

The discharge blade 50 may rotate and move between the guide position 50*a* and the closing position 50*b*. The discharge blade 50 may operate to selectively block the first and second flow paths 75*a* and 75*b*. When the discharge blade 50 is at the closing position 50*b*, the discharge blade 50 may close the outlet 14. In addition, the discharge blade 50 is configured to cover the sensor receiver 72 at the closing position 50*b* so that an internal configuration of the housing 10 is not exposed to the outside.

The discharge blade 50 may include a blade body 52 and a plurality of blade holes 56.

The blade body 52 may be formed to be rotatable around the blade shaft 59. The blade body 52 may be configured to correspond to the outlet 14. The blade body 52 may have an approximate plate shape. The plurality of blade holes 56 may be distributed in the blade body 52, and a width of each of the blade holes 56 may be smaller than that of the outlet 14. Also, even when the discharge blade 50 is at the closing position 50*b*, the air can be discharged to the outside of the housing 10 through the plurality of blade holes 56 of the discharge blade 50. The plurality of blade holes 56 and the plurality of holes 22 of the discharge plate 20 may also have the same size and the same shape or different sizes and different shapes.

The blade body 52 may include a guide part 53 and the flow path door part 54. The guide part 53 and the flow path door part 54 may be integrally formed.

The guide part 53 controls the direction of the air blown from the blower fan 45 and discharged to the outlet 14 when the discharge blade 50 is at the guide position 50*a*. The guide part 53 may change the direction of the air discharged to the outside of the housing 10 according to a rotation angle at which the blade shaft 59 is centered.

At the guide position 50*a*, the flow path door part 54 extends from the guide part 53 and is provided to block the air that flows in the second flow path 75*b*. When the discharge blade 50 is at the guide position 50*a*, the flow path door part 54 is configured to move the rotation space 79*a* formed by the curved surface guide 79. That is, when the discharge blade 50 is at the guide position 50*a*, the flow path door part 54 is configured to block the second flow path 75*b*. At the guide position 50*a*, the guide part 53 moves to the outside of the housing 10 and the flow path door part 54 relatively moves to the inside of the housing 10.

Hereinafter, an operation of an air conditioner according to the present disclosure will be described with reference to FIGS. 4, 5, and 6.

First, a case where the discharge blade 50 is at the closing position 50*b*, will be described.

When the discharge blade 50 is at the closing position 50*b*, the outlet 14 is closed by the discharge blade 50, and the second flow path 75*b* is open as shown in FIG. 4. Thus, air blown from the blower fan 45 flows in the first and second flow paths 75*a* and 75*b* to be discharged to the outside of the housing 10 through the plurality of holes 22 of the discharge plate 20 and the plurality of blade holes 56 of the discharge blade 50.

Next, a case where the discharge blade 50 is at the guide position 50*a* will be described.

When the discharge blade 50 is at the guide position 50*a*, the outlet 14 is open, and the second flow path 75*b* is blocked by the flow path door part 54 as shown in FIGS. 5 and 6. That is, air blown from the blower fan 45 can flow only through the first flow path 75*a*.

Thus, the air blown from the blower fan 45 flows along the first flow path 75*a* and is discharged to the outside of the housing 10 through the outlet 14.

Hereinafter, a coupling and disassembling of the discharge plate 20 in the air conditioner 1 will be described.

Figure 7:
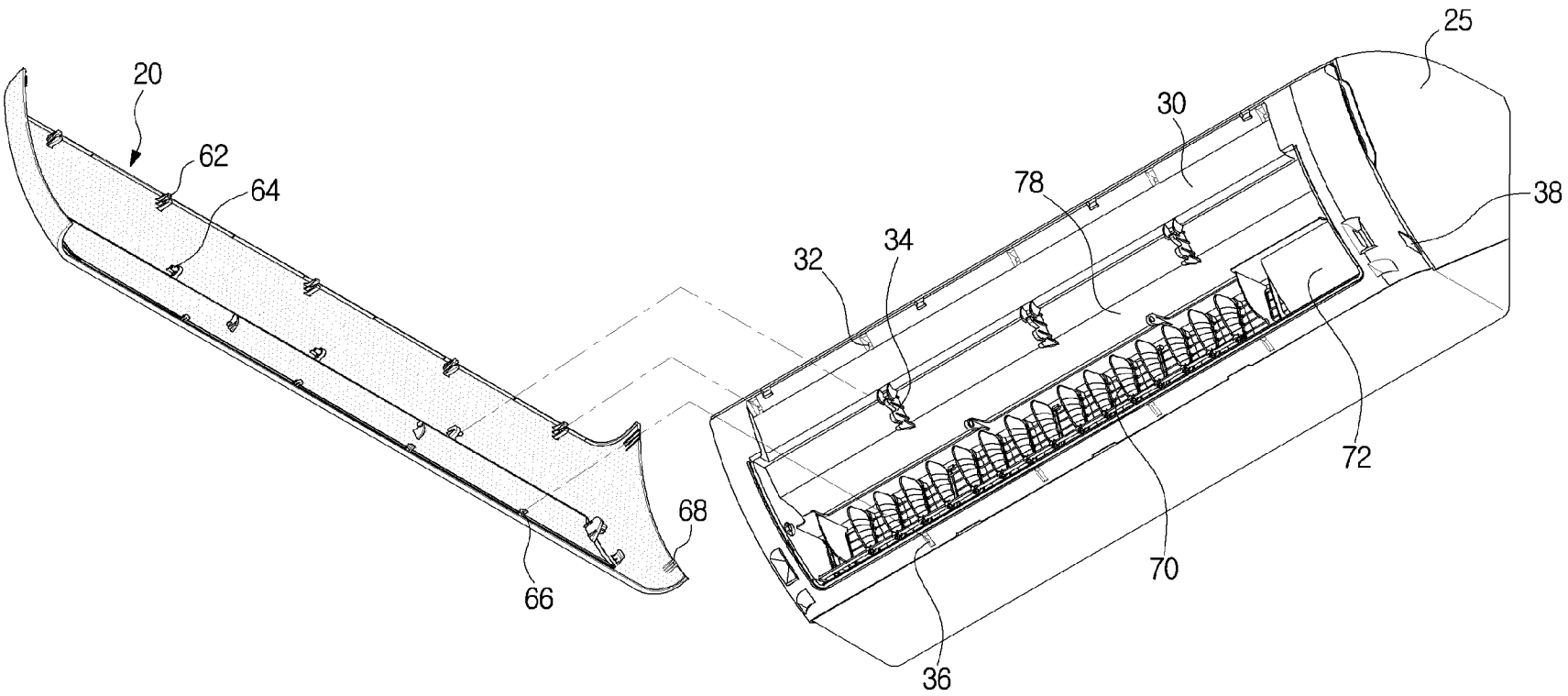
FIGS. 7 and 8 are views showing a disassembling of an air conditioner according to an embodiment of the present disclosure.
Figure 8:
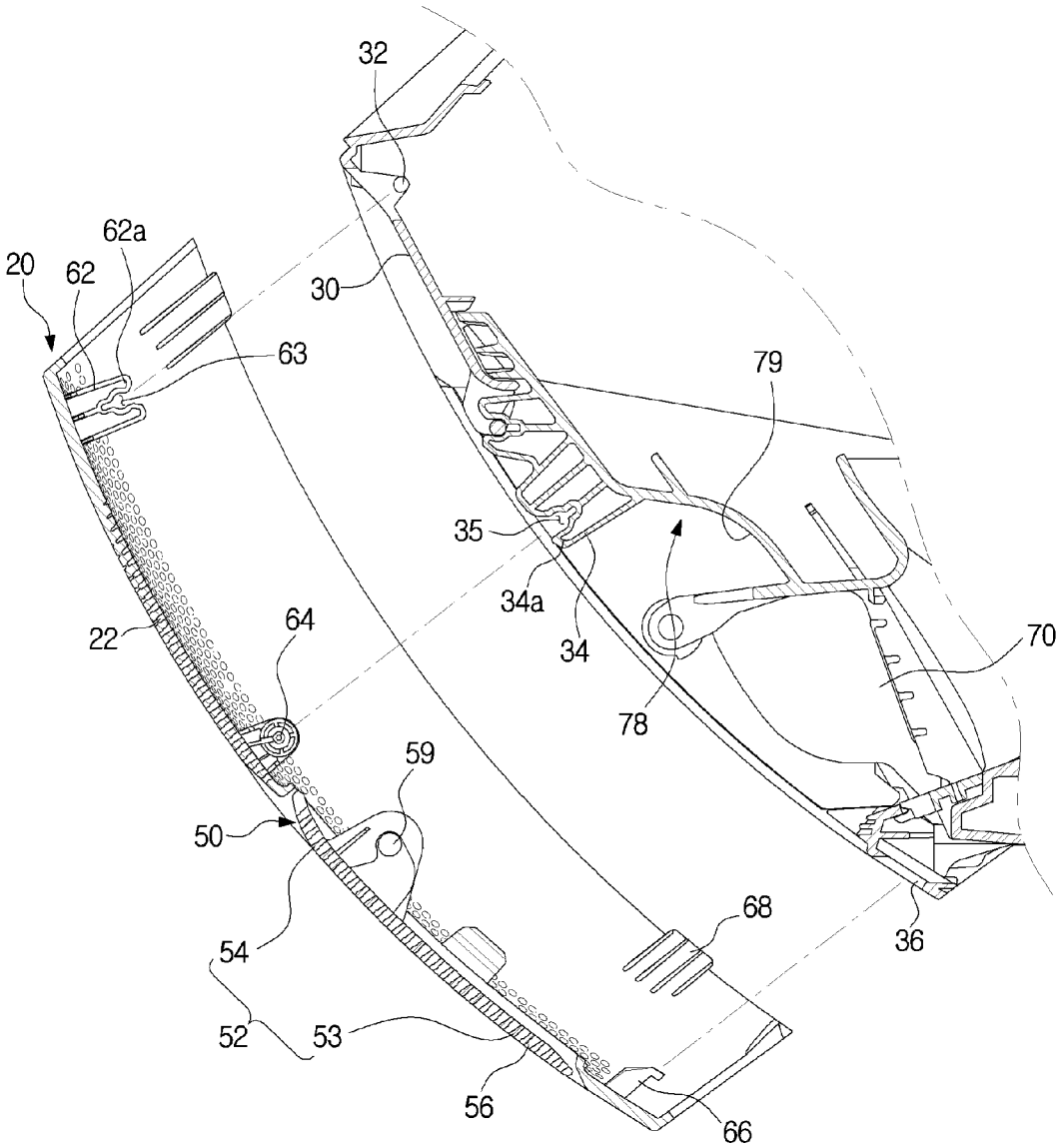

FIGS. 7 and 8 are views showing a disassembling of an air conditioner according to an embodiment of the present disclosure.

The discharge plate 20 may be detachably provided at the housing 10. The housing 10 may include a front frame 30, which is in an inside of the discharge plate 20, to which the discharge plate 20 may be coupled. That is, the discharge plate 20 may be detachably provided at the front frame 30. The front frame 30 may include the second flow path guide 78.

At least one coupling groove may be formed in any one of the discharge plate 20 and the front frame 30, and at least one coupling protrusion to be inserted in and coupled to the at least one coupling groove may be formed in the other one of the discharge plate 20 and the front frame 30.

In the current embodiment, the discharge plate 20 may include a first coupling member 62 that protrudes from a surface facing the front frame 30, and a first coupling groove 63 formed to be concave in an end of the first coupling member 62. Also, the front frame 30 may include a first coupling protrusion 32 to be inserted in and coupled to the first coupling groove 63 of the discharge plate 20.

The first coupling member 62 includes a pair of elastic legs 62*a* that have elasticity and spread. In detail, the pair of elastic legs 62*a* of the first coupling protrusion 32 are elastically deformed and spread while the first coupling protrusion 32 is being inserted into the first coupling groove 63, and when the first coupling protrusion 32 is inserted into the first coupling groove 63, the pair of spread elastic legs 62*a* elastically return. Through this configuration, the first coupling protrusion 32 does not deviate from the first coupling groove 63.

Also, the front frame 30 may include a second coupling member 34 that protrudes from a surface facing the discharge plate 20, and a second coupling groove 35 formed concavely in an end of the second coupling member 34. The discharge plate 20 may include a second coupling protrusion 64 to be inserted and coupled to the second coupling groove 35 of the front frame 30.

The second coupling member 34 includes a pair of elastic legs 34*a* that have elasticity and spread. In detail, the pair of elastic legs 34*a* of the second coupling protrusion 64 are elastically deformed and spread while the second coupling protrusion 64 is being inserted into the second coupling groove 35, and when the second coupling protrusion 64 is inserted into the second coupling groove 35, the pair of spread elastic legs 34*a* elastically return. Through this configuration, the second coupling protrusion 64 does not deviate from the second coupling groove 35.

At least one insertion hole 36 may be formed in any one of the discharge plate 20 and the front frame 30, and at least one hook 66 to hook the at least one insertion hole 36 may be formed in the other one of the discharge plate 20 and the front frame 30. In the current embodiment, the hook 66 that protrudes from the surface facing the front frame 30 may be formed in the discharge plate 20, and the insertion hole 36 is formed in the front frame 30 at a position corresponding to the hook 66 so that the hook 66 can hook the insertion hole 36.

The hook 66 may be coupled to the insertion hole 36 to withstand only a weight of the discharge plate 20. Through this configuration, the hook 66 may easily deviate from the insertion hole 36 when the first coupling member 62 and the first coupling protrusion 32 are separated from each other and the second coupling member 34 and the second coupling protrusion 64 are separated from each other.

In the current embodiment, the first coupling member 62, the second coupling protrusion 64, and the hook 66 are provided in order in the discharge plate 20, and the first coupling protrusion 32, the second coupling member 34, and a coupling groove are provided in order in the front frame 30. However, the order is not limited thereto.

The coupling members 34 and 62 and the coupling protrusions 32 and 64, and the hooks 66 and the insertion holes 36 are spaced a predetermined distance apart from each other in the horizontal direction that is a longitudinal direction of the air conditioner 1 so that the discharge plate 20 can be stably coupled to the front frame 30.

The discharge plate 20 may include step prevention protrusions 68 that protrude from both ends of the discharge plate 20. A pair of step prevention protrusions 68 may be provided at a left end and a right end of the discharge plate 20. The front frame 30 may include a pair of step prevention grooves (refer to 38 of FIG. 7) corresponding to the pair of step prevention protrusions. The pair of step prevention protrusions 68 are coupled to the pair of step prevention grooves 38 so that left and right sides of the discharge plate 20 can be coupled to the front frame 30 in parallel.

Hereinafter, the air conditioner 1 according to an embodiment of the present disclosure will be described. A description of the same configuration as the above-described configuration will be omitted.

Figure 9:
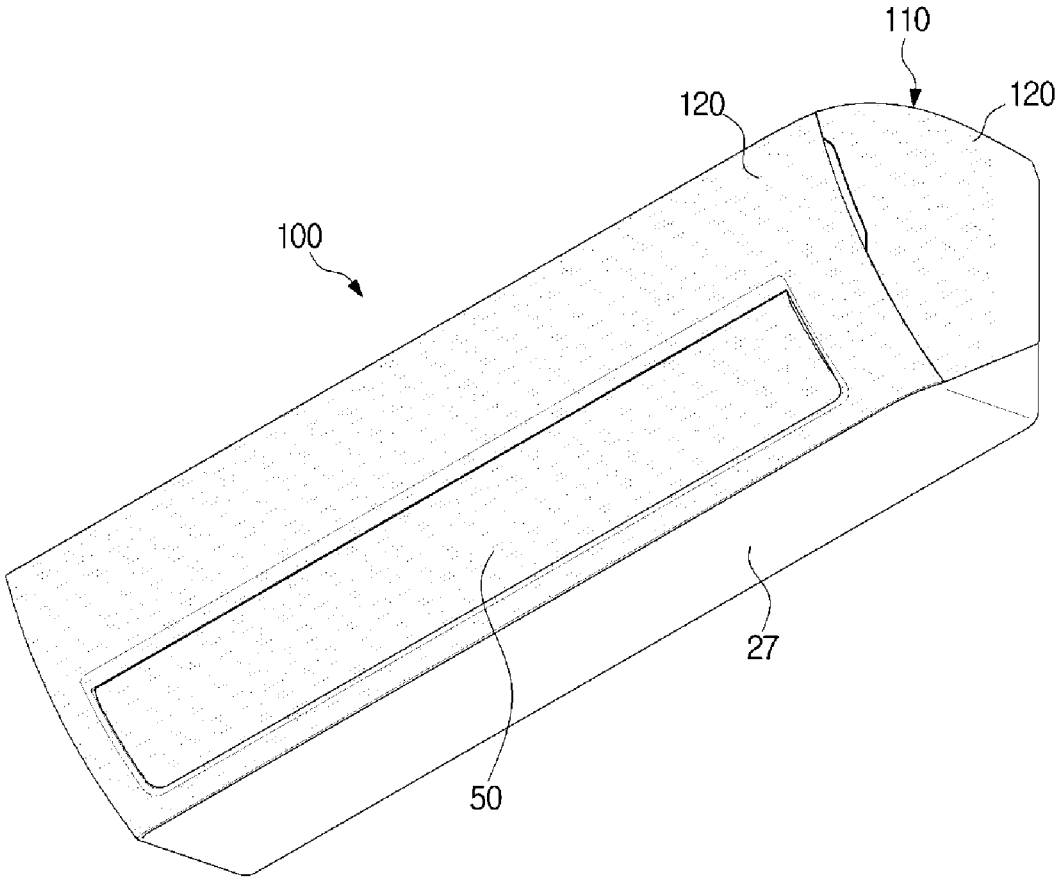
FIG. 9 is a perspective view of an air conditioner according to an embodiment of the present disclosure.

FIG. 9 is a perspective view of an air conditioner according to an embodiment of the present disclosure.

A housing 110 may form an entire exterior of an air conditioner 100. The housing 110 may include a discharge plate 120 having a plurality of holes 22 formed therein. The plurality of holes 22 may be distinguished from an outlet 14. The plurality of holes 22 are distributed in the discharge plate 120 as illustrated in FIG. 2, and a width of each of the holes 22 may be smaller than that of the outlet 14. In addition, air that flows in the second flow path 75*b* can be discharged to the outside of the housing 110 through the plurality of holes 22.

The housing 110 may include a front panel having an outlet 14 formed therein, a rear panel 24 disposed behind the front panel, a pair of side panels disposed between the front panel and the rear panel 24, an upper panel 26 having an inlet 12 formed therein and disposed above the plurality of side panels, and a lower panel 27 disposed below a pair of side panels 25.

The front panel and the pair of side panels may have the same configuration as that of the above-described discharge plate 120. That is, the discharge plate 120 is formed at a front side and both sides of the housing 110 so that a region in which the plurality of holes 22 are distributed can be enlarged.

Hereinafter, an air conditioner according to an embodiment of the present disclosure will be described. A description of the same configuration as the above-described configuration will be omitted.

Figure 10:
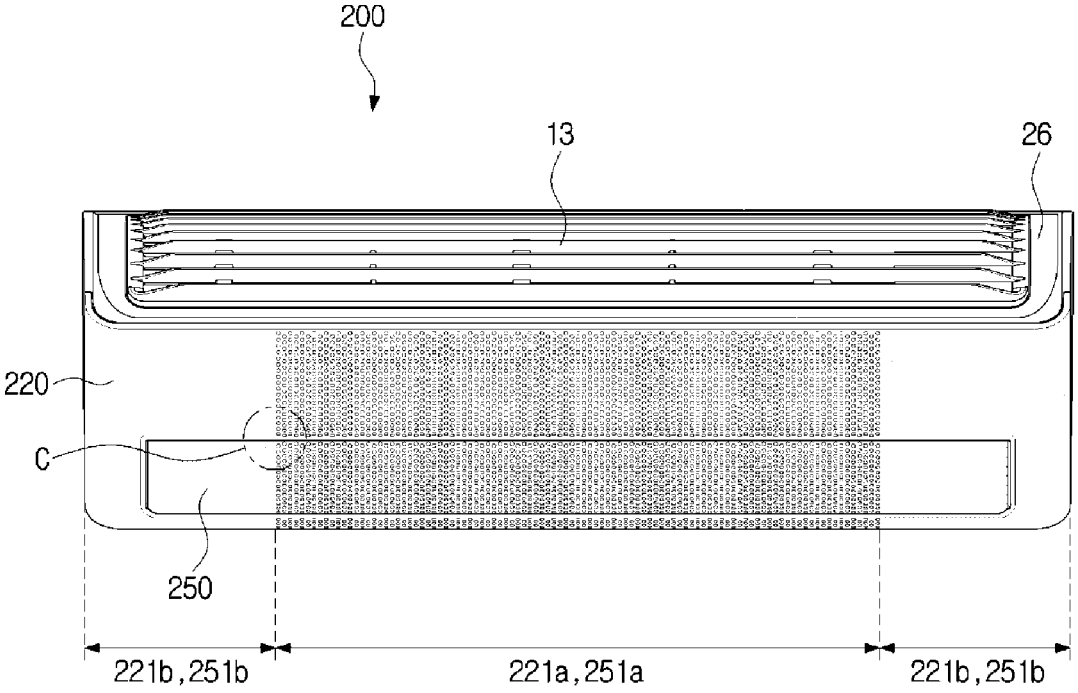
FIG. 10 is a front view of an air conditioner according to an embodiment of the present disclosure.
Figure 11:
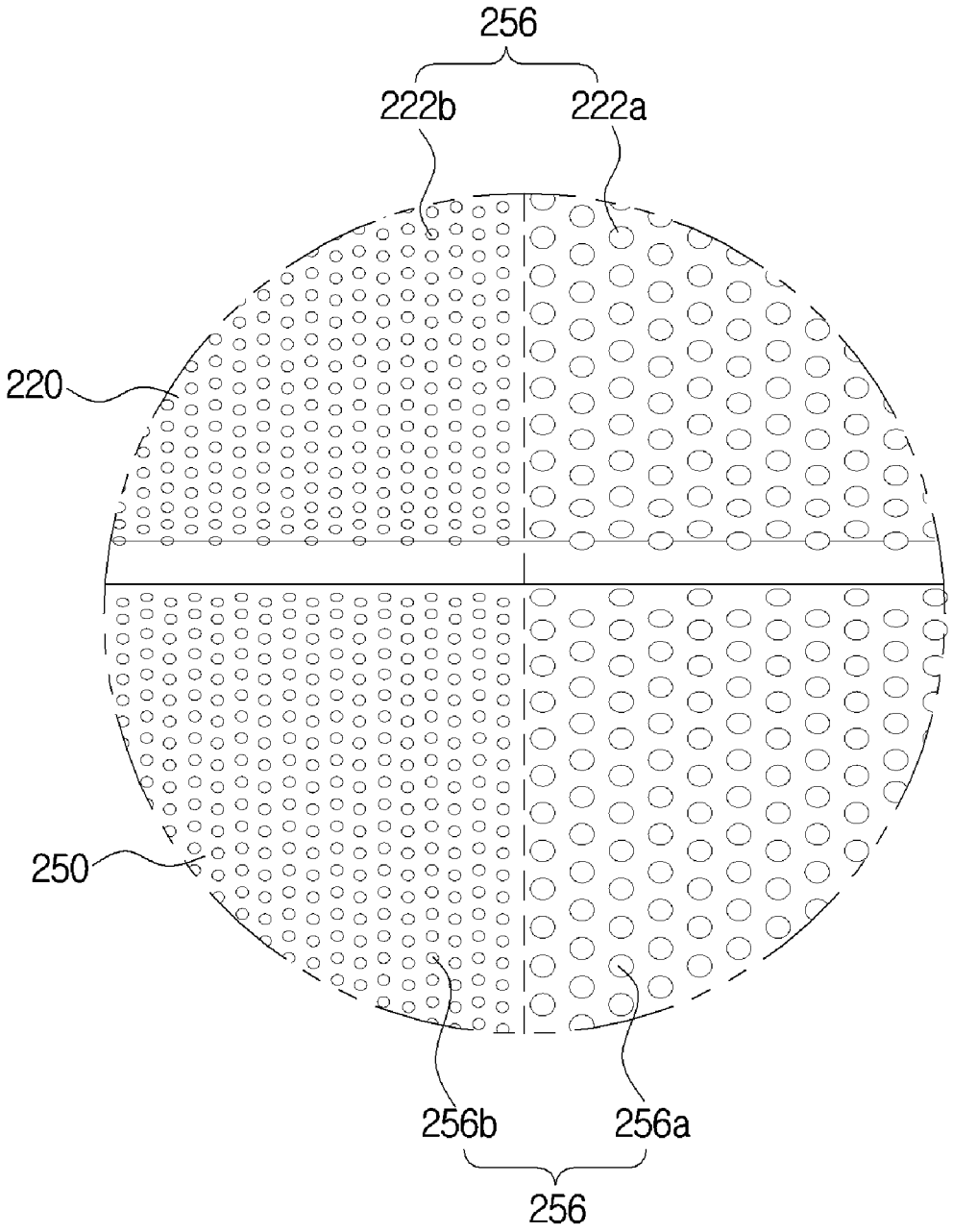
FIG. 11 is an enlarged view of portion C of FIG. 10.

FIG. 10 is a front view of an air conditioner according to an embodiment of the present disclosure, and FIG. 11 is an enlarged view of portion C of FIG. 10.

An air conditioner 200 may include a discharge plate 220 and a discharge blade 250.

The discharge plate 220 may include a plurality of holes 222, and the discharge blade 250 may include a plurality of blade holes 256.

A portion of the plurality of holes 222 in a section of the discharge plate 220 may have a larger size than that of a portion of the plurality of holes 222 in another section of the discharge plate 220. Similarly, a plurality of blade holes 256 in the section of the discharge blade 250 may have a larger size than that of the plurality of blade holes 256 in the other section of the discharge blade 250.

In the current embodiment, the discharge plate 220 may include a first section 221*a* and a second section 221*b*. A plurality of holes 222*a* in the first section 221*a* may have a larger size than that of a plurality of holes 222*b* in the second section 221*b*. The second section 221*b* may be provided at both left and right sides of the first section 221*a*. Through this configuration, a wind speed of air discharged through the plurality of holes 222*a* in the first section 221*a* is faster than a wind speed of air discharge through the plurality of holes 222*b* in the second section 221*b* so that the air discharged through the plurality of holes 222 of the discharge plate 220 can be linearly discharged forward.

Also, the discharge blade 250 may include a first blade section 251*a* and a second blade section 251*b*. A plurality of blade holes 256*a* in the first section 221*a* may have a larger size than of a plurality of blade holes 256*b* in the second section 221*b*. The second section 221*b* may be provided at both left and right sides of the first section 221*a*. Through this configuration, a wind speed of air discharged through the plurality of blade holes 256*a* in the first section 221*a* is faster than a wind speed of air discharged through the plurality of blade holes 256*b* in the second section 221*b* so that air discharged through the plurality of blade holes 256 of the discharge blade 250 can be linearly discharged forward.

In the current embodiment, a width of the first section 221*a* and a width of the first blade section 251*a* are identical to each other. However, embodiments of the present disclosure are not limited thereto. For example, the width of the first section 221*a* and the width of the first blade section 251*a* may be different from each other. In addition, the first and second sections 221*a* and 221*b* and the first and second blade sections 251*a* and 251*b* are arranged in the horizontal direction. However, embodiments of the present disclosure are not limited thereto, and the first and second sections 221*a* and 221*b* and the first and second blade sections 251*a* and 251*b* may be arranged in the vertical direction. Of course, a plurality of sections may be formed in the vertical and the horizontal directions so that a plurality of holes formed in a central part of the plurality of sections may have a larger size than that of a plurality of holes formed in an outside part of the plurality of sections.

Hereinafter, an air conditioner according to an embodiment of the present disclosure will be described. A description of the same configuration as that of the above-described configuration will be omitted.

Figure 12:
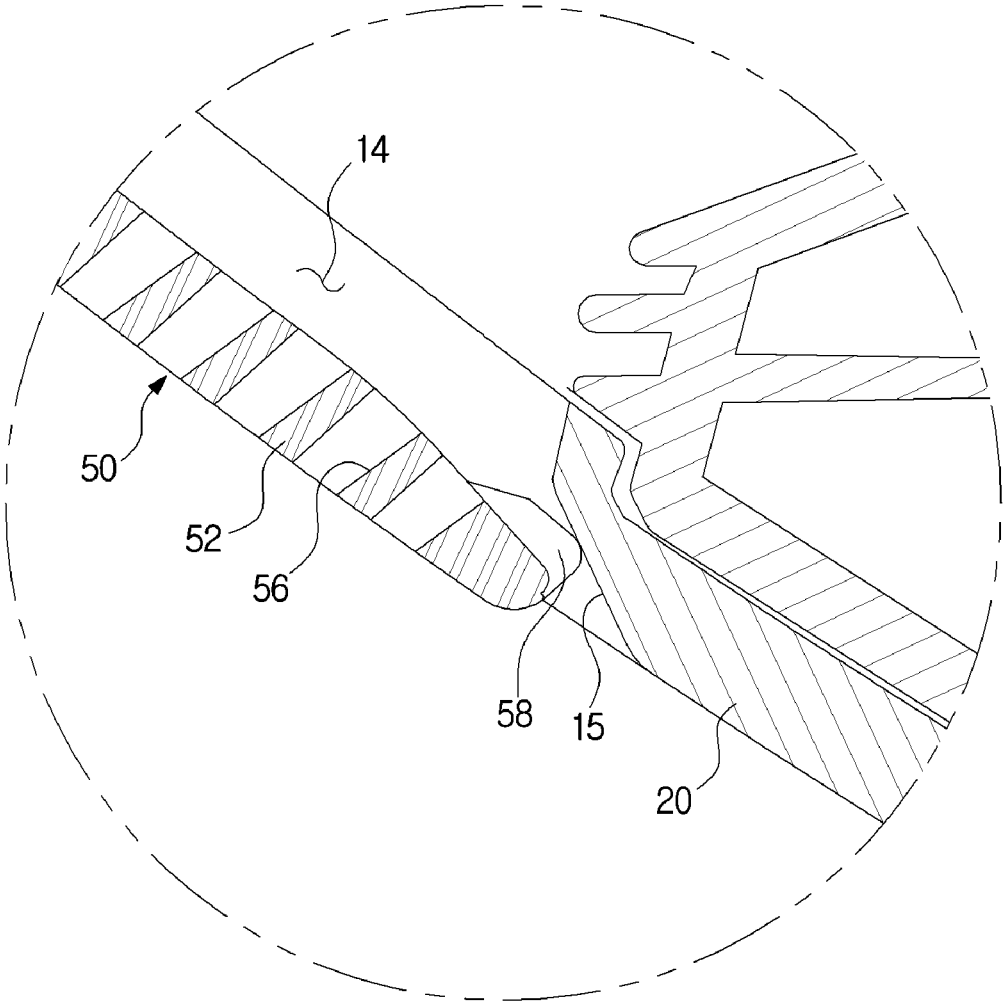
FIG. 12 is a view of portion B of FIG. 4 according to an embodiment of the present disclosure.

FIG. 12 is a view of portion B of FIG. 4 according to an embodiment of the present disclosure.

A discharge blade 50 may further include a separation protrusion 58.

The separation protrusion 58 may protrude from a blade body 52 to be spaced a predetermined distance apart from an outlet forming part 15. The separation protrusion 58 may be spaced the predetermined distance apart from the outlet forming part 15 with a predetermined gap between the blade body 52 and the outlet forming part 15.

When the blade body 52 and the outlet forming part 15 are in contact with each other, heat-exchanged air is stagnate between the blade body 52 and the outlet forming part 15 and dew is formed in the blade body 52 due to a temperature difference between inner and outer surfaces of the blade body 52. Due to the separation protrusion 58, the blade body 52 and the outlet forming part 15 may be spaced a predetermined distance apart from each other so that a small amount of air can be discharged to the outside of the housing 10 by the predetermined gap to prevent the occurrence of this phenomenon. Through this configuration, heat-exchanged air flows on the outer surface of the blade body 52, so that dew can be prevented from being formed in the blade body 52.

Hereinafter, an air conditioner according to an embodiment of the present disclosure will be described. A description of the same configuration as that of the above-described configuration will be omitted.

Figure 13:
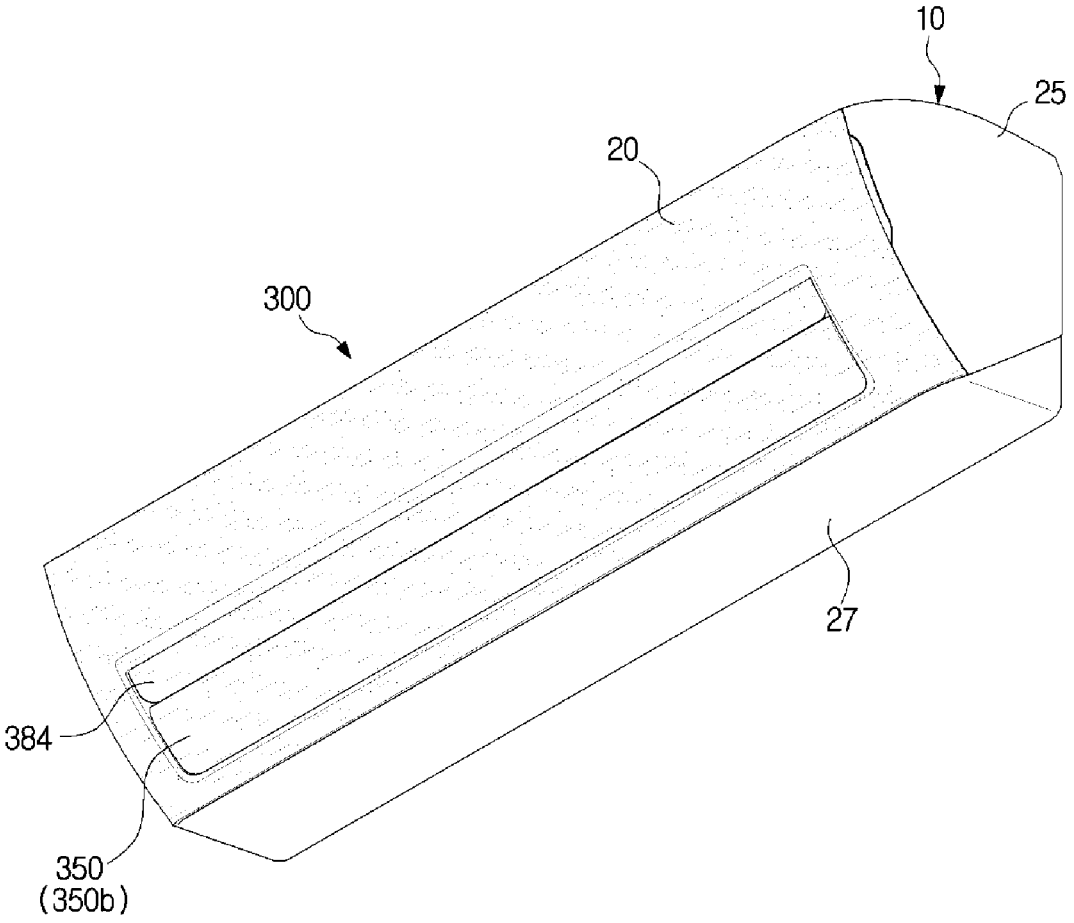
FIG. 13 is a perspective view of an air conditioner according to an embodiment of the present disclosure.
Figure 14:
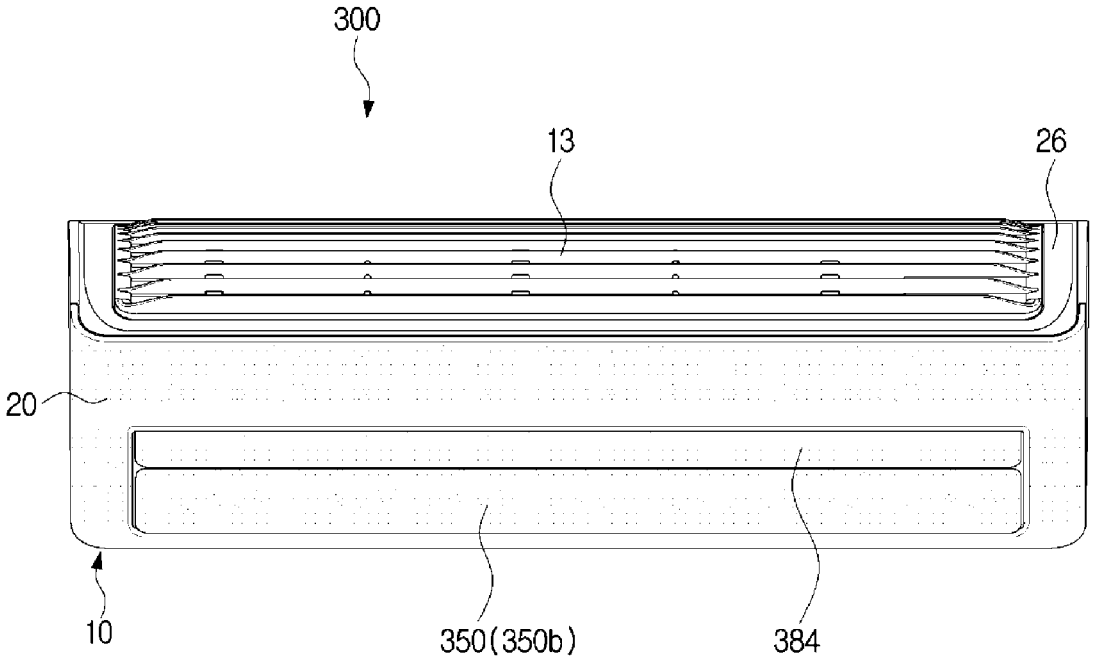
FIG. 14 is a front view of an air conditioner according to an embodiment of the present disclosure.

FIG. 13 is a perspective view of an air conditioner according to an embodiment of the present disclosure, FIG. 14 is a front view of an air conditioner according to an embodiment of the present disclosure, and FIGS. 15 through 18 are views showing an operation of an air conditioner according to an embodiment of the present disclosure.

An air conditioner 300 may include a discharge blade 350 that opens/closes an outlet 14. The discharge blade 350 may include a blade body 52, a blade hole 356, and a blade shaft 359. The discharge blade 350 is rotatably provided in a housing 310. In detail, the discharge blade 350 may be provided inside the housing 310 to be rotatable around the blade shaft 359. The blade shaft 359 may be disposed at an inner surface of a discharge plate 320.

The discharge blade 350 may be provided to move between a closing position 350*b* at which the outlet 14 is closed, and a guide position 350*a* at which air blown from a blower fan 45 is guided by being rotated from the closing position 350*b*.

The air conditioner 300 may include a flow path blade 380.

The flow path blade 380 is rotatably provided in the housing 310. In detail, the flow path blade 380 may be rotatably provided in a second flow path guide 78. The flow path blade 380 may be rotatably provided to block a second flow path 75*b*. The flow path blade 380, which is a separate configuration from the discharge blade 350, may operate independently from the discharge blade 350. The flow path blade 380 may have a rotation shaft 382 spaced a predetermined distance apart from the blade shaft 359 of the discharge blade 350 and may rotate around the rotation shaft 382. That is, the discharge blade 350 may operate to close the outlet 14, and the flow path blade 380 may operate to close the second flow path 75*b*.

The flow path blade 380 is provided to move between an open position 380*a* at which the flow path blade 380 is in close contact with the second flow path guide 78 to prevent interference of a flow of air passing through the second flow path 75*b*, and a closing position 380*b* at which the second flow path 75*b* is blocked.

The air conditioner 300 may include a moving blade 384. The moving blade 384 may be disposed on an outlet forming part 15 of the discharge plate 320 and may be slidable with respect to the discharge plate 320. In detail, the discharge plate 320 includes an insertion space 386 into which the moving blade 384 is inserted, and the moving blade 384 may be provided to be inserted into the insertion space 386, or at least a part of the moving blade 384 may be exposed from the discharge plate 320. The moving blade 384 may have a plurality of holes 385 formed therein, like the discharge plate 320 or the discharge blade 350. That is, due to a sliding operation of the moving blade 384, a width of the discharge plate 320 may be enlarged.

Figure 17:
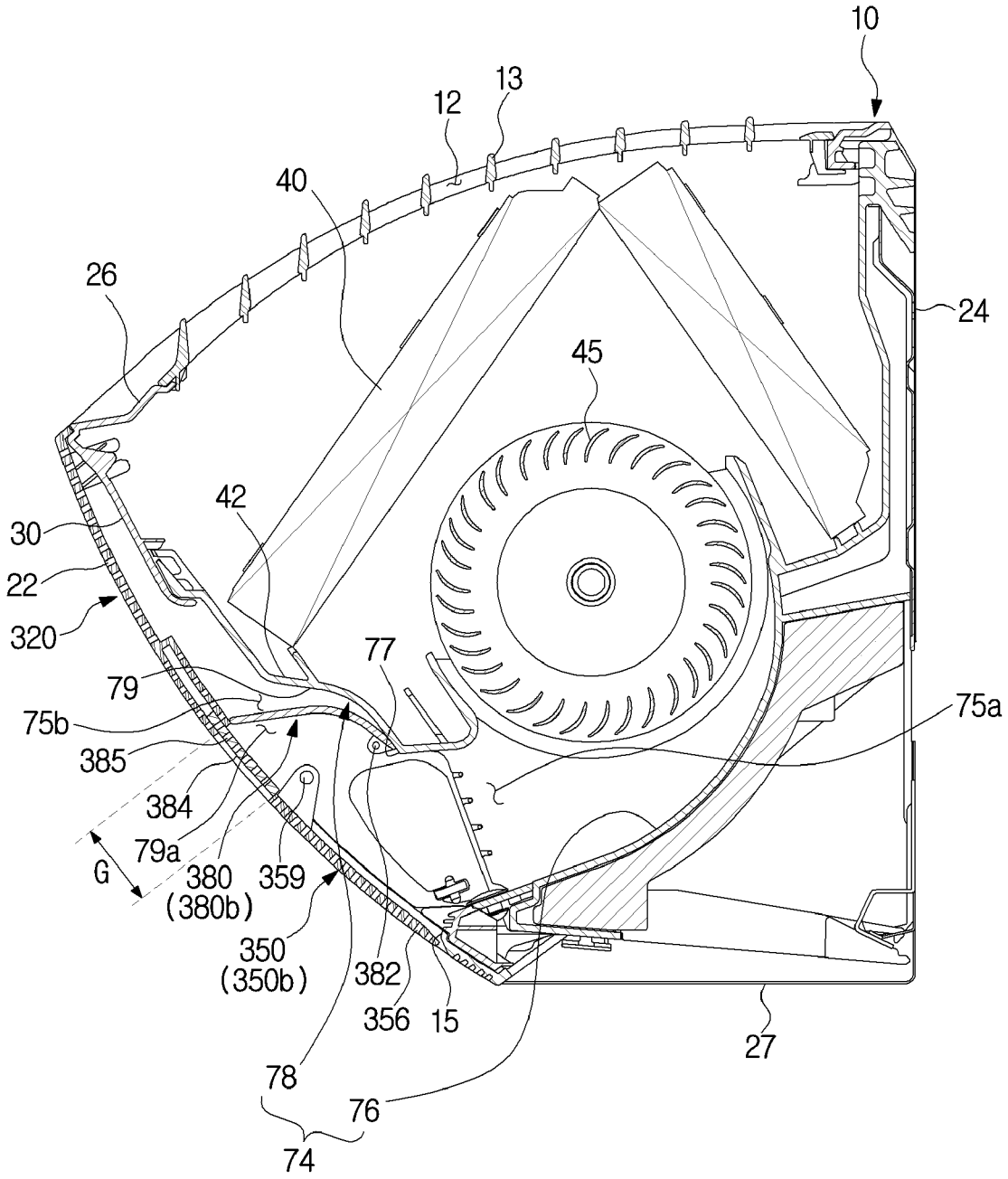

When the discharge blade 350 rotates around the blade shaft 359, a gap G is formed between the discharge blade 350 and an upper portion of the outlet forming part 15 as shown in FIG. 17. The moving blade 384 may be configured to be slidable from the discharge plate 320 so as to fill the gap G. The moving blade 384 may operate in conjunction with the discharge blade 350. That is, when the discharge blade 350 is at the closing position 350*b*, the moving blade 384 may be slidable downwards and may fill the gap G, and when the discharge blade 350 is at the guide position 350*a*, the moving blade 384 may be pressurized by the discharge blade 350, may move upwards, and may be inserted into the insertion space 386.

Hereinafter, an operation of an air conditioner according to the present disclosure will be described.

For convenience of explanation, first through fourth modes will be described.

Figure 15:
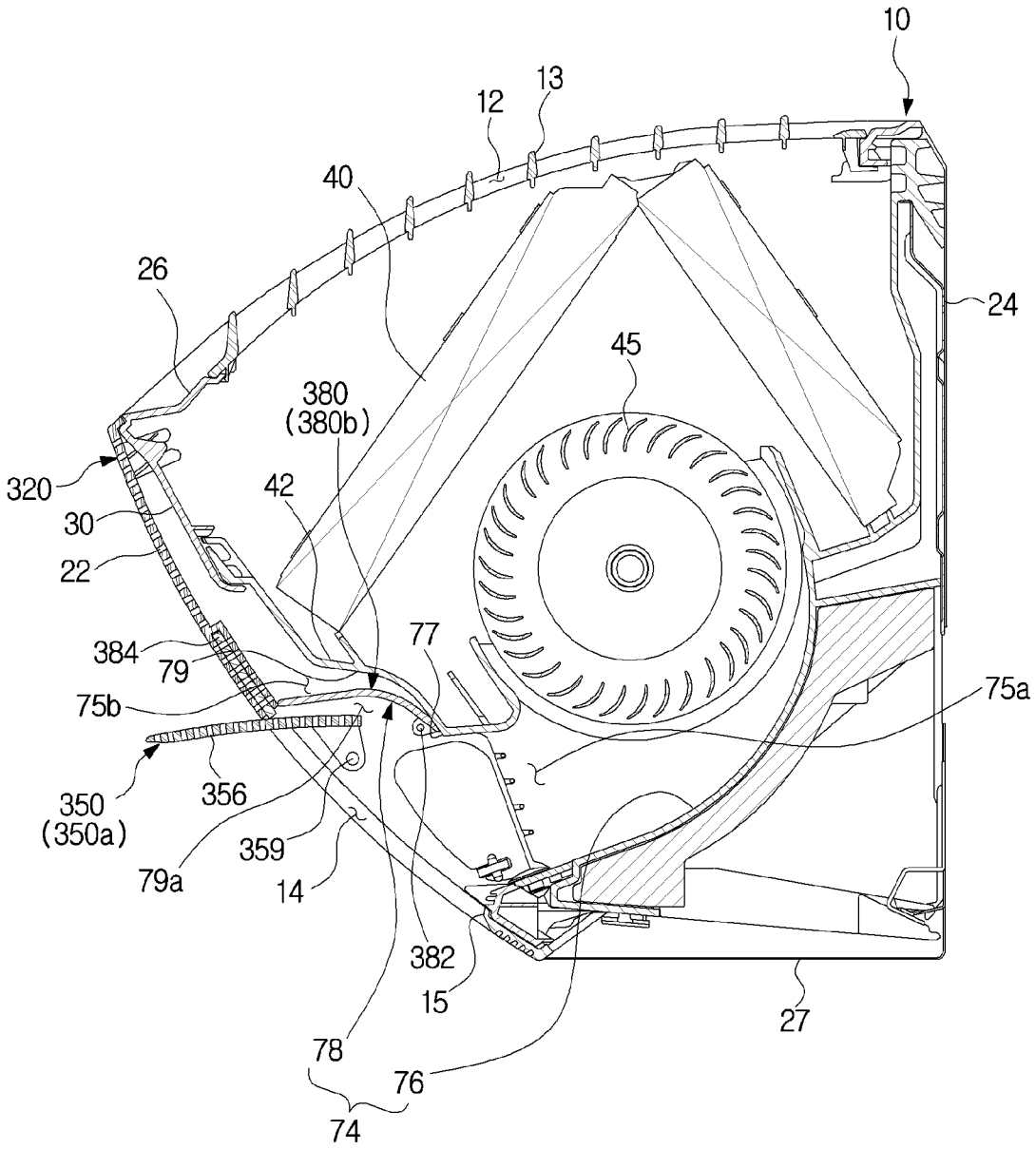
FIGS. 15, 16, 17, and 18 are views showing an operation of an air conditioner according to an embodiment of the present disclosure.

A first mode is an operation mode in which air blown from the blower fan 45 is discharged to the outlet 14 as shown in FIG. 15. The discharge blade 350 is disposed at the guide position 350*a* and opens the outlet 14, and the flow path blade 380 is disposed to close the second flow path 75*b*. The moving blade 384 is pressurized by the discharge blade 350, and at least a part of the moving blade 384 is inserted into the insertion space 386. Since the discharge blade 350 is rotated by a predetermined angle at the guide position 350*a*, the discharge blade 350 is slidable. Through this configuration, the air blown from the blower fan 45 may move along the first flow path 75*a* and may be discharged to the outside of the housing 310 through the outlet 14.

Figure 16:
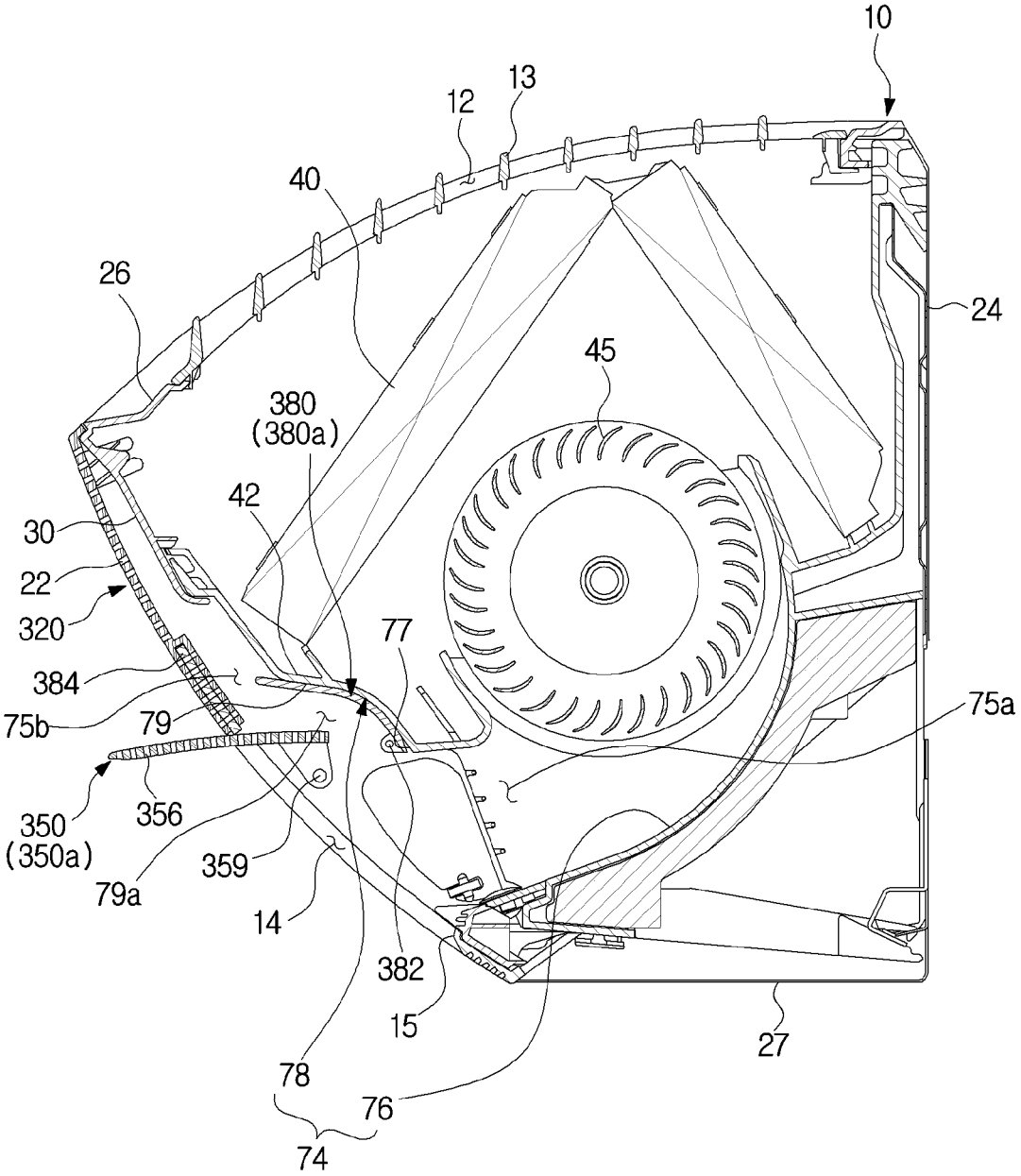

A second mode is an operation mode in which air blown from the blower fan 45 is discharged through the outlet 14 and the plurality of holes 22 as shown in FIG. 16. The discharge blade 350 is disposed at the guide position 350*a* and opens the outlet 14, and the flow path blade 380 is disposed to open the second flow 75*b*. The moving blade 384 is pressurized by the discharge blade 350, and at least a part of the moving blade 384 is inserted into the insertion space 386. Since the discharge blade 350 is rotated by a predetermined angle at the guide position 350*a*, the discharge blade is slidable. Through this configuration, the air blown from the blower fan 45 flows along the first and second flow paths 75*a* and 75*b* and may be discharged to the outside of the housing 310 through the outlet 14, the plurality of holes 22 of the discharge plate 320, and the plurality of holes 22 of the moving blade 384.

A third mode is an operation mode in which air blown from the blower fan 45 is discharged through a plurality of blade holes 356 of the discharge blade 350 and the plurality of holes 385 of the moving blade 384, as shown in FIG. 17. The discharge blade 350 is disposed at the closing position 350*b* and closes the outlet 14, and the flow path blade 380 is disposed to close the second flow path 75*b*. The moving blade 384 may slide downwards so that at least a part of the moving blade 384 protrudes toward the discharge blade 350 and the moving blade 384 is in contact with the discharge blade 350. Through this configuration, the air blown from the blower fan 45 may flow along the first flow path 75*a* and may be discharged through the plurality of blade holes 356 of the discharge blade 350 and the plurality of holes 385 of the moving blade 384.

Figure 18:
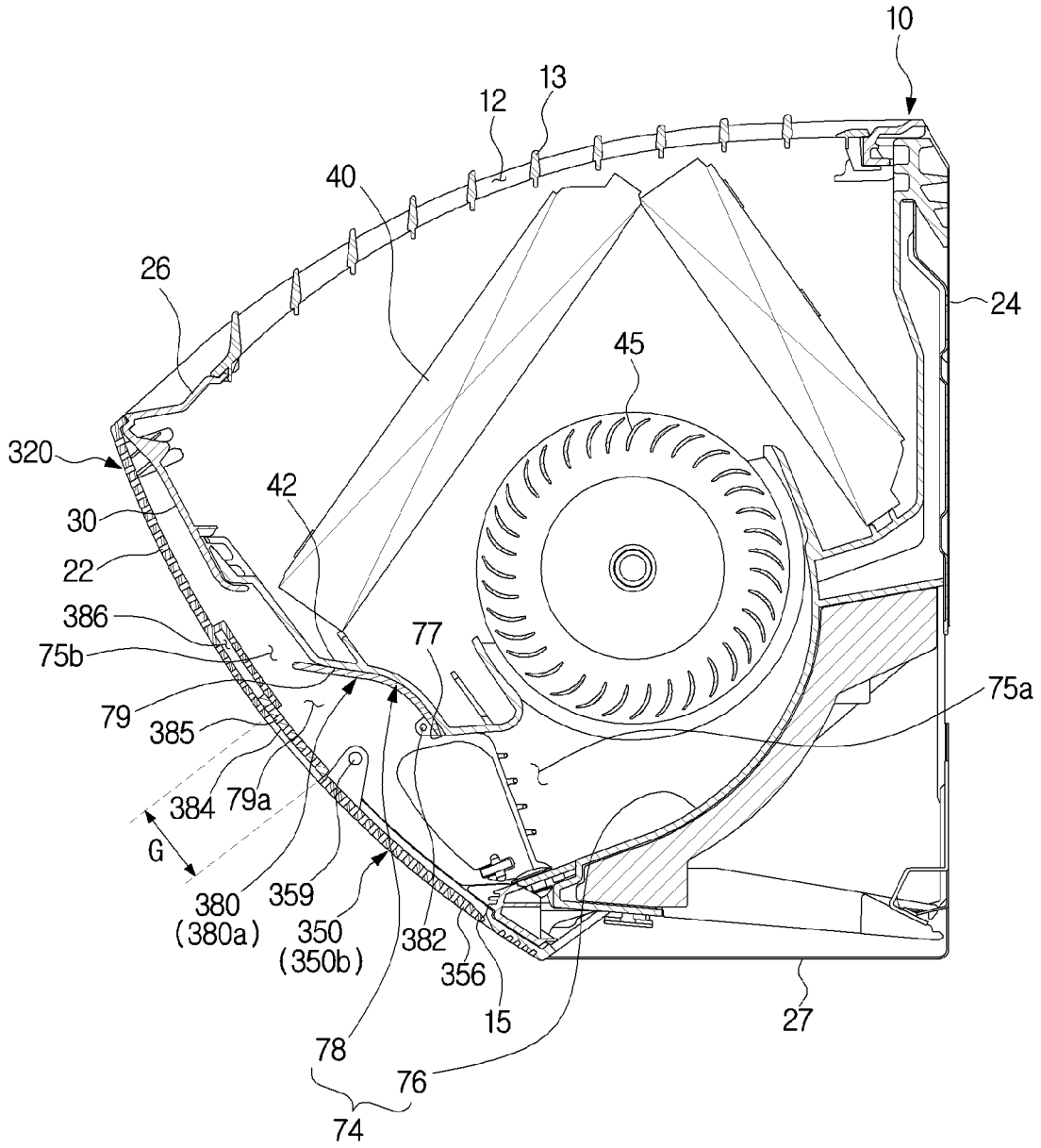

A fourth mode is an operation mode in which air blown from the blower fan 45 is discharged through the plurality of holes 22 of the discharge plate 320, the plurality of blade holes 356 of the discharge blade 350, and the plurality of holes 385 of the moving blade 384 as shown in FIG. 18. The discharge blade 350 is disposed at the closing position 350*b* and closes the outlet 14, and the flow path blade 380 is disposed to open the second flow path 75*b*. The moving blade 384 may slide downwards so that at least a part of the moving blade 384 protrudes toward the discharge plate 320 and the moving blade 384 is in contact with the discharge blade 350. Through this configuration, the air blown from the blower fan 45 flows along the first and second flow paths 75*a* and 75*b* and may be discharged to the outside of the housing 310 through the plurality of holes 22 of the discharge plate 320, the plurality of holes 385 of the moving blade 384, and the plurality of blade holes 356 of the discharge blade 350.

Hereinafter, an air conditioner according to an embodiment of the present disclosure will be described. A description of the same configuration as the above-described configuration will be omitted.

FIGS. 19 through 22 are views showing an operation of an air conditioner according to an embodiment of the present disclosure;

A housing 10 may include a housing door 490.

The housing door 490 may be disposed at a front surface of a discharge plate 20 and may be provided to move between an open position 490*a* at which the discharge plate 20 is exposed to the outside, and a closing position 490*b* at which the front surface of the discharge plate 20 is blocked.

The housing door 490 may be configured to be slidable between the open position 490*a* and the closing position 490*b*. The housing door 490 may include a first door 491 and a second door 492 disposed below the first door 491. The first door 491 may open/close a top part of the front surface of the discharge plate 20, and the second door 492 may open/close a bottom part of the front surface of the discharge plate 20. The first and second doors 491 and 492 may operate to be in contact with each other when the housing door 490 is at the closing position 490*b*.

The second door 492 may open/close the bottom part of the front surface of the discharge plate 20, i.e., a part of a discharge blade 50. Thus, in an operation in which the discharge blade 50 is disposed at a guide position 50*a* and air is discharged through an outlet 14, only the second door 492 may be open.

When the air conditioner does not operate, the first and second doors 491 and 492 are disposed at the closing position 490*b* so that the discharge plate 20 or the discharge blade 50 is not exposed to the outside. Thus, foreign substances can be prevented from being accumulated in a plurality of holes 22 or a plurality of blade holes 56.

Hereinafter, an air conditioner according to an embodiment of the present disclosure will be described. A description of the same configuration as the above-described configuration will be omitted.

Figure 23:
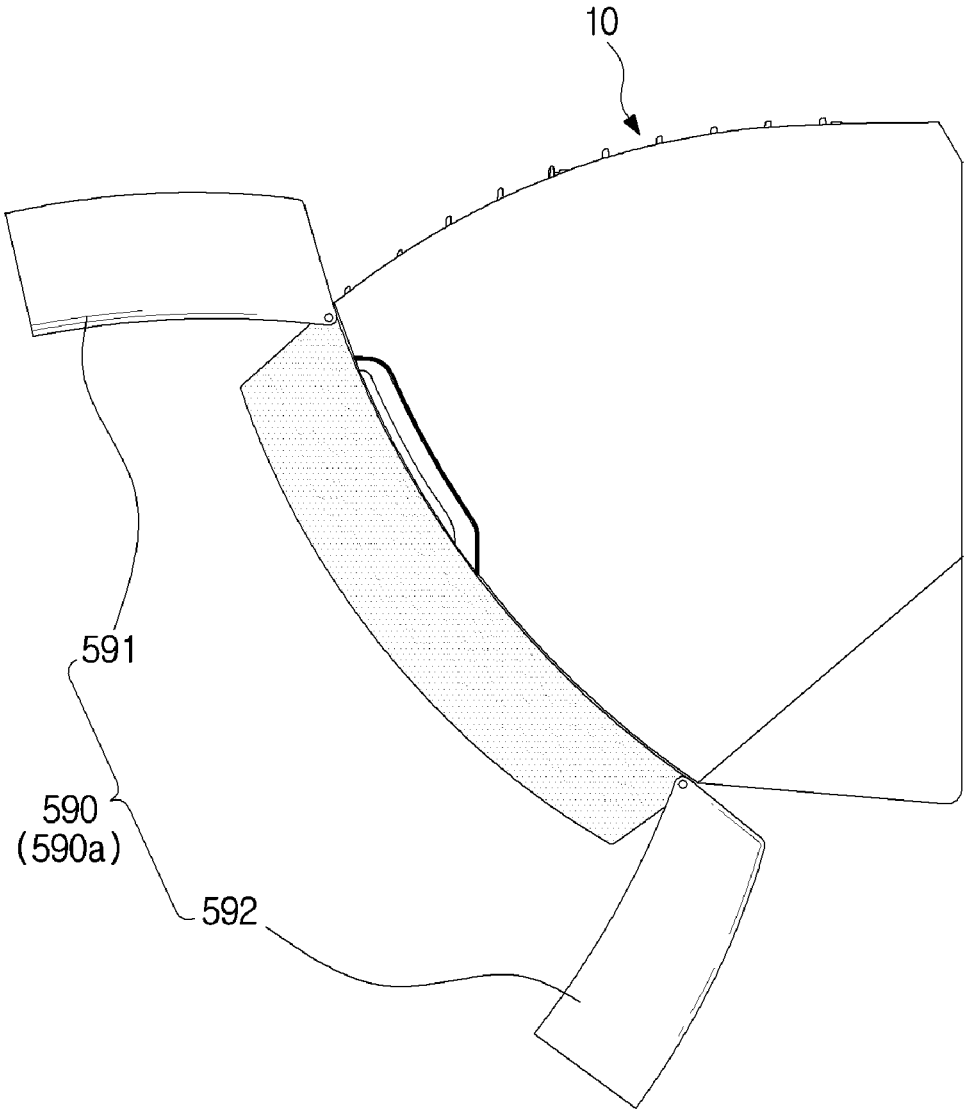
FIG. 23 is a view showing an operation of an air conditioner according to an embodiment of the present disclosure.

FIG. 23 is a view showing an operation of an air conditioner according to an embodiment of the present disclosure.

A housing 10 may include a housing door 590.

Figure 19:
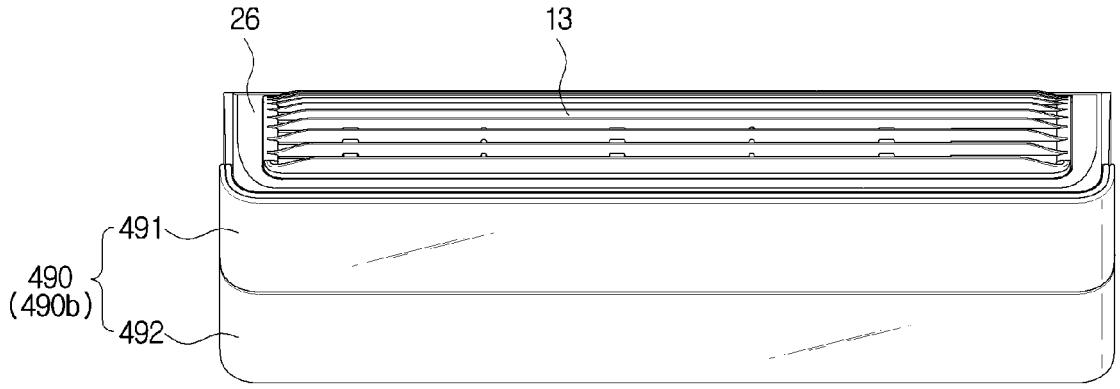
FIGS. 19, 20, 21, and 22 are views showing an operation of an air conditioner according to an embodiment of the present disclosure.
Figure 20:
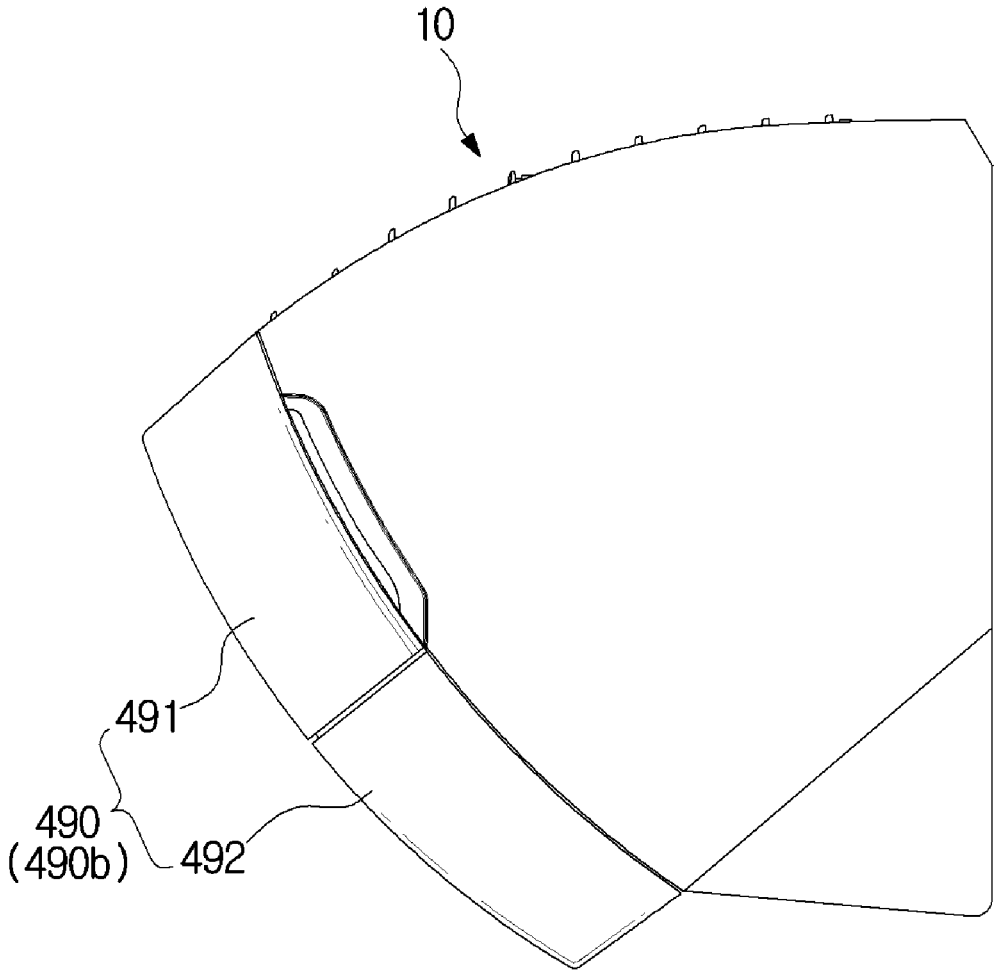
Figure 21:
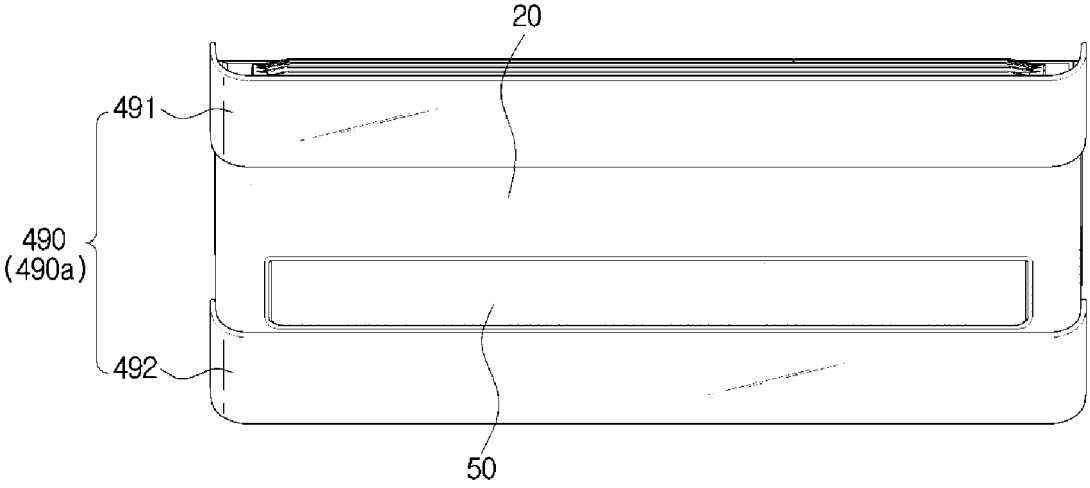
Figure 22:
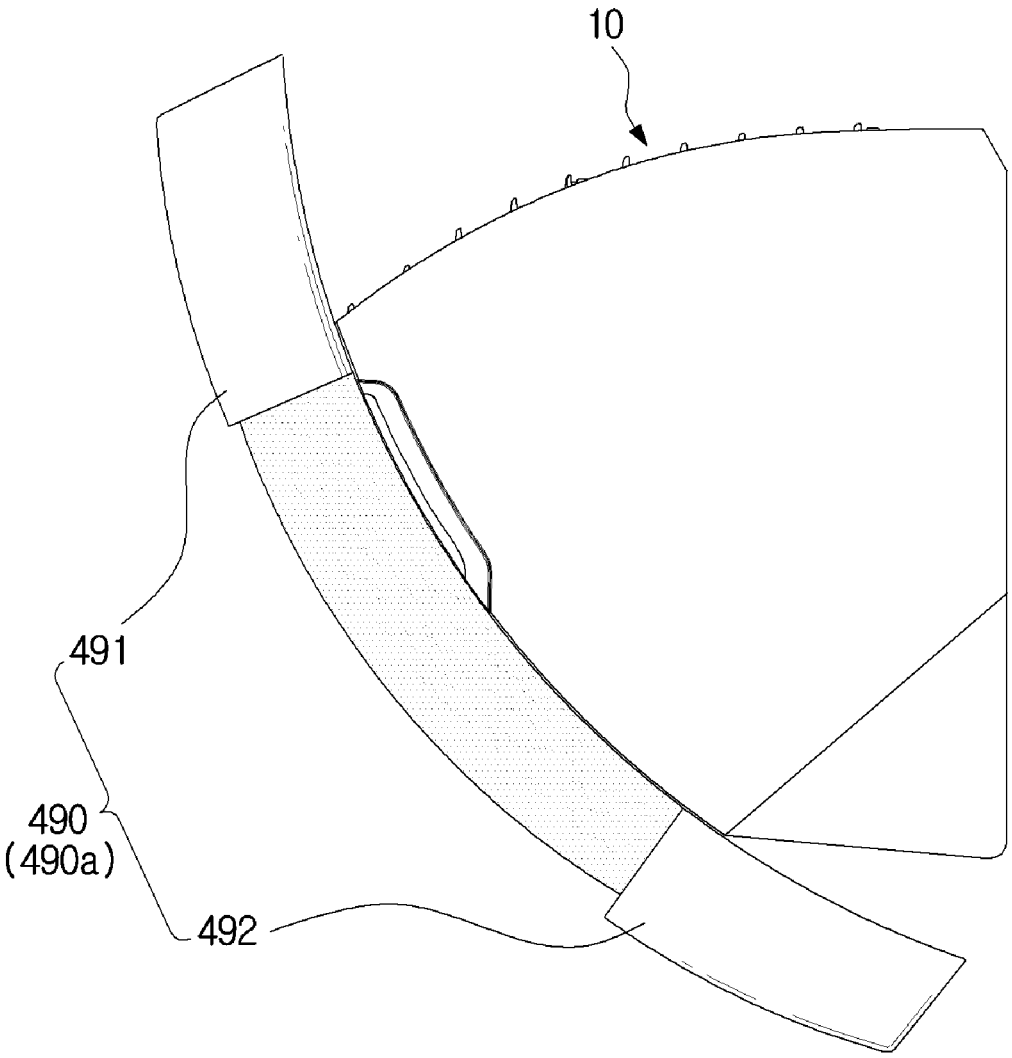

The housing door 590 may be disposed at a front surface of a discharge plate 20 and may be provided to move between an open position 590*a* at which the discharge plate 20 is exposed to the outside, and a closing position at which the front surface of the discharge plate 20 is blocked. Although the closing position of the housing door 590 is not shown, the housing door 590 may be configured to cover the front of the housing 10, as illustrated in FIGS. 19 and 20.

The housing door 590 may be configured to rotate and move between the open position 590*a* and the closing position. The housing door 590 may include a first door 591 and a second door 592 disposed below the first door 591. The first door 591 may open/close a top part of the front surface of the discharge plate 20, and the second door 592 may open/close a bottom part of the front surface of the discharge plate 20. The first and second doors 591 and 592 may operate to be in contact with each other when the housing door 590 is at the closing position. The first and second doors 591 and 592 are hinge-coupled to the housing 10, and thus may rotate upwards and downwards, respectively.

Hereinafter, an air conditioner according to an embodiment of the present disclosure will be described. A description of the same configuration as the above-described configuration will be omitted.

Figure 24:
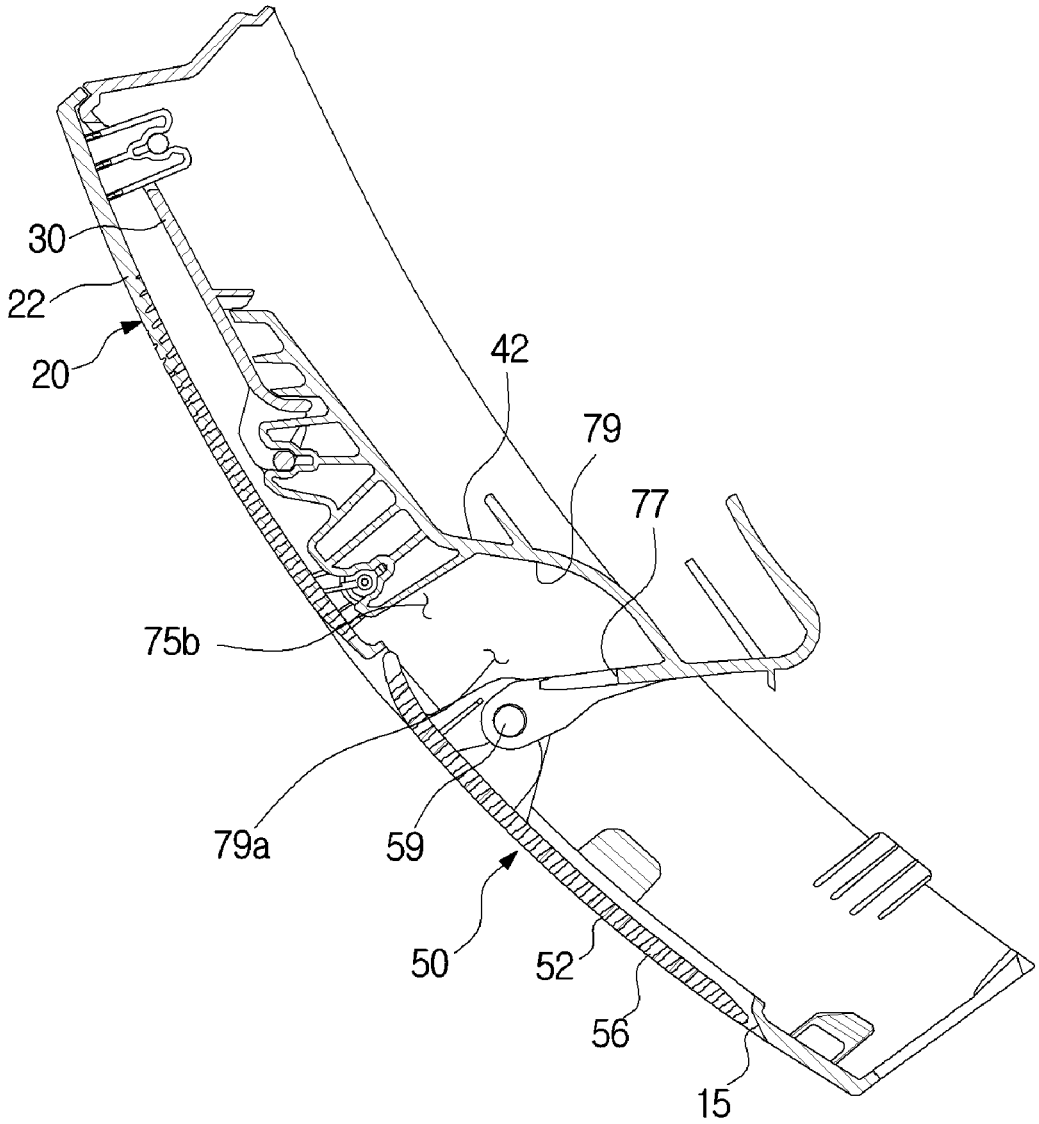
FIG. 24 is a view of an air conditioner according to an embodiment of the present disclosure.

FIG. 24 is a view of an air conditioner according to an embodiment of the present disclosure.

A discharge plate 20 and a front frame 30 may be detachably provided in a housing 10. The discharge plate 20 and the front frame 30, which are one module, may be separated from the air conditioner 1. The discharge plate 20 and the front frame 30 are configured as one module so that embodiments of the present disclosure can be applied to air conditioners to which the embodiments of the present disclosure are not applied.

As described above, in an air conditioner according to the present disclosure, heat-exchanged air can be discharged by varying a wind speed.

In addition, a blowing method of heat-exchanged air can vary according to an environment of a user.

In addition, heat-exchanged air is controlled not to be blown directly toward a user so that the user's satisfaction can be improved.

Although a few embodiments of the present disclosure have been shown and described, it should be appreciated by those skilled in the art that changes may be made in these embodiments without departing from the principles and spirit of the disclosure, the scope of which is defined in the claims and their equivalents.

What is claimed is:

1. An air conditioner comprising:

a housing including a front frame, a side panel, and an outlet;

a heat exchanger inside the housing;

a blower fan configured to blow air heat-exchanged by the heat exchanger toward the outlet; and a discharge blade configured to move between a guide position at which a direction of air blown by the blower fan is controlled so that the air is discharged through the outlet, and a closing position at which the outlet is closed, wherein the side panel includes a plurality of holes formed therein, wherein the discharge blade includes a blade body rotatably disposed in the outlet, and a plurality of blade holes formed in the blade body to discharge air through the discharge blade, and wherein air blown by the blower fan is discharged through the plurality of blade holes of the discharge blade and the plurality of holes of the side panel while the discharge blade is in the closing position.

2. The air conditioner according to claim 1, wherein the housing includes a front panel coupled to the front frame, and the discharge blade is substantially flush with the front panel.

3. The air conditioner according to claim 1, further comprising:

a flow path guide including a first flow path guide forming a first flow path for air blown by the blower fan to flow to the outlet, and a second flow path guide forming a second flow path which diverges from the first flow path for air blown by the blower fan to flow through the plurality of holes of the side panel.

4. The air conditioner according to claim 3, wherein the blade body includes:

a guide part configured to, when the discharge blade is in the guide position, control the direction of air blown by the blower fan so that the air is discharged through the outlet, and a flow path door part extending from the guide part and configured to, when the discharge blade is in the guide position, block the second flow path.

5. The air conditioner according to claim 4, further comprising:

a flow path blade configured to be movable between a closed position to block air blown by the blower fan and an open position to allow air blown by the blower fan.

6. The air conditioner according to claim 5, wherein the flow path blade is movable between the open position and the closed position while the discharge blade is in the closing position.

7. The air conditioner according to claim 5, wherein the flow path blade is movable between the open position and the closed position while the discharge blade is in the guide position.

8. The air conditioner according to claim 5, wherein the flow path blade and the discharge blade are operable independently of each other.

9. An air conditioner comprising:

a housing including an outlet, and a side panel having a plurality of holes extending through the side panel;

a heat exchanger inside the housing;

a blower fan inside the housing and configured to blow air heat-exchanged by the heat exchanger; and a discharge blade having a plurality of holes extending through the discharge blade, wherein the discharge blade is rotatable between a guide position at which the outlet is open and air blown by the blower fan is guided by the discharge blade to be discharged through the outlet to outside of the housing, and a closing position at which the discharge blade is in the outlet, a first portion of air blown by the blower fan is discharged through the plurality of holes extending through the side panel to thereby be discharged outside of the housing, and a second portion of air blown by the blower fan is discharged through the plurality of holes extending through the discharge blade to thereby be discharged outside of the housing.

10. The air conditioner according to claim 9, wherein the housing includes a front panel, and the discharge blade is substantially flush with the front panel.

* * * * *